US010147350B2

(12) United States Patent
Hu et al.

(10) Patent No.: US 10,147,350 B2
(45) Date of Patent: Dec. 4, 2018

(54) METHOD AND APPARATUS FOR INCREASING PERCEIVED DISPLAY RESOLUTIONS FROM AN INPUT IMAGE

(71) Applicants: Darwin Hu, San Jose, CA (US); Tsunglu Syu, Fremont, CA (US)

(72) Inventors: Darwin Hu, San Jose, CA (US); Tsunglu Syu, Fremont, CA (US)

( * ) Notice: Subject to any disclaimer, the term of this patent is extended or adjusted under 35 U.S.C. 154(b) by 0 days.

(21) Appl. No.: 15/806,015

(22) Filed: Nov. 7, 2017

(65) Prior Publication Data

US 2018/0061301 A1 Mar. 1, 2018

Related U.S. Application Data

(63) Continuation-in-part of application No. 15/596,951, filed on May 16, 2017, which is a continuation of application No. 14/340,999, filed on Jul. 25, 2014, now Pat. No. 9,653,015.

(60) Provisional application No. 61/859,968, filed on Jul. 30, 2013, provisional application No. 61/859,289, filed on Jul. 28, 2013, provisional application No. 61/858,669, filed on Jul. 26, 2013.

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 3/3648* (2013.01); *G09G 3/2014* (2013.01); *G09G 3/3614* (2013.01); *G09G 2300/0804* (2013.01); *G09G 2300/0842* (2013.01); *G09G 2300/0857* (2013.01); *G09G 2330/025* (2013.01)

(58) Field of Classification Search
CPC .. G09G 3/2074; G09G 3/3648; G09G 3/3607; G09G 3/3614; G09G 2300/0857; G09G 2300/0842; G09G 2300/0804; G09G 3/2014; G09G 2330/025
See application file for complete search history.

(56) References Cited

U.S. PATENT DOCUMENTS 8,836,860 B2 * 9/2014 Lee ..... H04N 5/145 348/452
9,258,518 B2 * 2/2016 Salvador ..... G06T 3/4053
2008/0094419 A1 * 4/2008 Leigh ..... G09G 3/007 345/660
2009/0060365 A1 * 3/2009 Nagata ..... G09G 3/20 382/255
2009/0087120 A1 * 4/2009 Wei ..... G06T 3/403 382/266
2010/0110086 A1 * 5/2010 Yun ..... H04N 7/0132 345/520
2011/0081080 A1 * 4/2011 Miyata ..... G09G 3/3648 382/167
2011/0081094 A1 * 4/2011 Damkat ..... G06T 3/4053 382/254

(Continued)

*Primary Examiner* — Premal R Patel
(74) *Attorney, Agent, or Firm* — Joe Zheng

(57) ABSTRACT

Techniques for displaying a video or images in perceived better resolution are described. An input image is expanded into two frames based on the architecture of sub-pixels. A first frame is derived from the input image while the second frame is generated based on the first frame. These two frames are of equal size to the input image and displayed alternatively at twice the refresh rate of the input image.

18 Claims, 27 Drawing Sheets

(56) References Cited

U.S. PATENT DOCUMENTS

| | | | | |
|---|---|---|---|---|
| 2012/0183224 | A1* | 7/2012 | Kirsch | G06K 9/4619<br>382/195 |
| 2012/0313843 | A1* | 12/2012 | Kondoh | G09G 3/2003<br>345/55 |
| 2014/0327820 | A1* | 11/2014 | Iketani | H04N 7/012<br>348/452 |
| 2015/0358629 | A1* | 12/2015 | Choi | H04N 19/70<br>375/240.02 |
| 2016/0005344 | A1* | 1/2016 | Stine | G09G 3/007<br>345/428 |
| 2016/0021384 | A1* | 1/2016 | Croxford | G06T 1/00<br>375/240.12 |

* cited by examiner

| number of sub elements | binary code | Number of patterns |
|---|---|---|
| 0 | 0000 | 1 |
| 1 | 0001 | 16 |
| 2 | 0010 | 120 |
| 3 | 0011 | 560 |
| 4 | 0100 | 1820 |
| 5 | 0101 | 4368 |
| 6 | 0110 | 8008 |
| 7 | 0111 | 11440 |
| 8 | 1000 | 12870 |
| 9 | 1001 | 11440 |
| 10 | 1010 | 8008 |
| 11 | 1011 | 4368 |
| 12 | 1100 | 1820 |
| 13 | 1101 | 560 |
| 14 | 1110 | 120 |
| 15 | 1111 | 16 |

METHOD AND APPARATUS FOR INCREASING PERCEIVED DISPLAY RESOLUTIONS FROM AN INPUT IMAGE

CROSS REFERENCE TO RELATED APPLICATIONS

This application is a continuation-in-part (CIP) of U.S. application Ser. No. 15/596,951, which is a continuation of U.S. application Ser. No. 14/340,999, now U.S. Pat. No. 9,653,015, which claims the priorities of the following provisional applications for all purpose: U.S. Prov. App. Ser. No. 61/858,669 entitled "Dynamic Pixel Cell with Field Invert", filed on Jul. 26, 2013, U.S. Prov. App. Ser. No. 61/859,289, entitled "Spatial Density Modulation and Programmable Resolution of Picture Element with Multiple Sub-image Elements on Image Array", filed on Jul. 28, 2013, and U.S. Prov. App. Ser. No. 61/859,968 entitled "Pixel Cell with Capacitor for Digital Modulation", filed on Jul. 30, 2013.

BACKGROUND OF THE INVENTION

Field of the Invention

The present invention generally relates to the area of display devices and more particularly relates to architecture and designs of display devices, where the display devices are of high in both spatial and intensity resolutions, and may be used in various projection applications, storage and optical communications.

Description of the Related Art

In a computing world, a display usually means two different things, a showing device or a presentation. A showing device or a display device is an output mechanism that shows text and often graphic images to users while the outcome from such a display device is a display. The meaning of a display is well understood to those skilled in the art given a context. Depending on application, a display can be realized on a display device using a cathode ray tube (CRT), liquid crystal display (LCD), light-emitting diode, gas plasma, or other image projection technology (e.g., front or back projection, and holography).

A display is usually considered to include a screen or a projection medium (e.g., a surface or a 3D space) and supporting electronics that produce the information for display on the screen. One of the important components in a display is a device, sometime referred to as an imaging device, to form images to be displayed or projected on the display. An example of the device is a spatial light modulator (SLM). It is an object that imposes some form of spatially varying modulation on a beam of light. A simple example is an overhead projector transparency.

Usually, an SLM modulates the intensity of the light beam. However, it is also possible to produce devices that modulate the phase of the beam or both the intensity and the phase simultaneously. SLMs are used extensively in holographic data storage setups to encode information into a laser beam in exactly the same way as a transparency does for an overhead projector. They can also be used as part of a holographic display technology.

Depending on implementation, images can be created on an SLM electronically or optically, hence electrically addressed spatial light modulator (EASLM) and optically addressed spatial light modulator (OASLM). This current disclosure is directed to an EASLM. As its name implies, images on an electrically addressed spatial light modulator (EASLM) are created and changed electronically, as in most electronic displays. An example of an EASLM is the Digital Micromirror Device or DMD at the heart of DLP displays or Liquid crystal on silicon (LCoS or LCOS) using ferroelectric liquid crystals (FLCoS) or nematic liquid crystals (electrically controlled birefringence effect).

JVC, a Japanese company, introduced what is commercially called e-shift technology to increase a spatial display resolution from an input image. By using a special computer-controlled refractor in the lens system and doubling the refresh rate, a 1920×1080 source image can be displayed as 3840×2160. Essentially, e-shift uses the refractor to offset two frames of the same resolution (1920×1080) by ½ pixel pitch to mimic a perceived higher resolution (3840×2160 from 1920×1080). Besides the complexity and cost of finely placing and controlling the refractor in the lens system, the e-shift technology cannot take true native high-resolution video data, neither deliver 3D display. Accordingly, there has been always a need for solutions capable of displaying images in higher or improved resolutions at reasonable cost.

SUMMARY OF THE INVENTION

This section is for the purpose of summarizing some aspects of the present invention and to briefly introduce some preferred embodiments. Simplifications or omissions in this section as well as in the abstract and the title may be made to avoid obscuring the purpose of this section, the abstract and the title. Such simplifications or omissions are not intended to limit the scope of the present invention.

The present invention is generally related to architecture and designs of displaying images at higher or improved resolution, where display devices equipped with such designs may be readily used in various display or projection applications, storage and optical communications. According to one aspect of the present invention, an input image is first expanded into two frames based on the architecture of sub-pixels. A first frame is derived from the input image while the second frame is generated based on the first frame. These two frames are of equal size to the input image and displayed alternatively at twice the refresh rate originally set for the input image.

According to another aspect of the present invention, the input image and/or the two separated image frames are processed to minimize possible artifacts that may be introduced when the input image is expanded and separated into the two frames. Depending on implementation, upscaling, sharpening, edge detection and/or pixel-interpolation may be used to expand an image so as to produce the two image frames while minimizing the artifacts. A separation process is applied to separate the expanded and processed image by separating the intensity across the image so that, when the two frames are displayed alternatively, the intensity of the input image is maintained.

According to another aspect of the present invention, the second frame is produced by shifting the first frame one sub-pixel along a predefined direction (e.g., northeast) to minimize the memory requirement. To facilitate the image shifting in real time, memory decoders are specifically designed to address all sub-pixels in a pixel element simultaneously. Multiplexors or switches are used in the decoders to control how sub-pixels in one pixel element and in another pixel element are addressed. By utilizing a common sub-pixel in two neighboring pixel elements, referred herein as pivoting pixel, each of the memory cells is simplified, resulting in less components, smaller size and lower cost of a memory array for displaying images in improved resolution or native resolution. For completeness, both analog and digital versions of the memory array are described.

According to another aspect of the present invention, a display device includes a memory array having image elements, each of the image elements further includes an array of image sub-elements. These sub-image elements are driven by a modulation technique (e.g. Pulse Width Modulation or PWM), where only a portion of an image element area is turned on, namely, some of the sub-image elements are turned on, which has the same perceived effect of turning on an entire image element for a specific time. As the resolution of PWM is limited to the liquid crystal response time, modulating a portion of an image element area provides finer gray levels beyond what is currently available in digital modulation. In other words, image elements with sub-image elements increase the spatial resolution to break the limitation in the temporal intensity resolution due to the liquid crystal response time.

According to another aspect of the present invention, as referred to herein as gray level driving scheme, a hybrid approach is described to address the limitations in both digital drive scheme and analog drive scheme. An n-bit gray scale is first divided into two parts. The m most significant bits (MSB) of the n-bit gray scale form a group to generate $2^m$ of distinct voltage levels between two voltages, and remaining n-m bits of the gray scale are implemented with $2^{n-m}$ pulses of equal duration in one frame, similar to count-based Pulse Width Modulation (C-PWM) in digital drive scheme. Assigning more bits to the MSB group greatly reduces the total bit count needed to implement the n-bit gray scale, gradually approaching the bit count of analog drive scheme, resulting in a finer gray scale.

According to still another aspect of the present invention, designs of an image element or a sub-image element are described to achieve the high resolution display devices, both in spatial and intensity. In one embodiment, a display device is designed to include a plurality of image elements, each of the image elements including a set of sub-image elements arranged in rows and columns, each of the sub-image elements addressed by a control line and a data line, and a driving circuit provided to drive the image elements in accordance with a video signal to be displayed via the display device, the driving circuit designed to turn on a portion of each of the image elements to achieve similar perceived effect of having the each of the image elements turned on for a predefined time.

According to yet another aspect of the present invention, only some of the sub-image elements in an image element are tuned on in response to a brightness level assigned to the image element to achieve an intensity level in a much finer scale.

The present invention may be implemented as an apparatus, a method, a part of system. Different implementations may yield different benefits, objects and advantages. According to one embodiment, the present invention is a method for displaying an input image in improved perceived resolution, the method comprising: determining a native resolution of the input image at an interface to a memory array when the improved perceived resolution is greater than twice the native resolution; expanding the input image into an expanded image in the memory array having a plurality of pixel elements, each of the pixel elements including at least 2×2 sub-pixels; producing from the expanded image a first frame and a second frame of image, both of the first and second frames being of equal size to the input image; and displaying the first and second frames alternatively at twice refresh rate originally set for the input image; and displaying the input image in the native resolution when the improved perceived resolution is less than twice the native resolution.

According to another embodiment, the present invention is a device for displaying an input image in improved perceived resolution, the device comprises: a memory array having a plurality of pixel elements, each of the pixel elements including 2×2 sub-pixels and an interface to a memory array to determine a native resolution of an input image. When the improved perceived resolution is greater than twice the native resolution: the input image is expanded into an expanded image in the memory array by writing each of pixel value into the 2×2 sub-pixels; a first frame and a second frame of image are then generated from the expanded image, both of the first and second frames being of equal size to the input image; and the first and second frames are alternatively displayed at twice refresh rate originally set for the input image. When the improved perceived resolution is less than twice the native resolution: the input image is simply displayed in the native resolution. The device further comprises a controller programmed to control the switch signal to cause writing each pixel value in the input image into the 2×2 sub-pixels simultaneously and processing the expanded image to minimize visual errors when the first and second frames are alternatively displayed at the twice refresh rate.

According to yet another embodiment, the present invention is a circuit comprising: a set of cells, a horizontal decoder and a vertical decoder. Each of the cells is provided to store a pixel value to drive a pixel element on a display, wherein N and M are different or equal integers. The horizontal decoder includes a plurality of horizontal switches, each of the horizontal switches provided to address at least two rows of the cells simultaneously, wherein each the horizontal switches are controlled by a horizontal switch signal to toggle among three rows of the cells with the middle row of the cells always selected. The vertical decoder includes a plurality of vertical switches, each of the vertical switches provided to address at least two rows of the cells simultaneously, wherein each the vertical switches are controlled by a vertical switch signal to toggle among three columns of the cells with the middle column of the cells always selected. One of the cells in each of the groups is always selected regardless of how the horizontal and vertical switches are toggled, and is a pivot pixel and only needs to be updated every other cycle of the horizontal and vertical switch signals.

There are many other objects, together with the foregoing attained in the exercise of the invention in the following description and resulting in the embodiment illustrated in the accompanying drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

The detailed description of the invention is presented largely in terms of procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Figure 1:
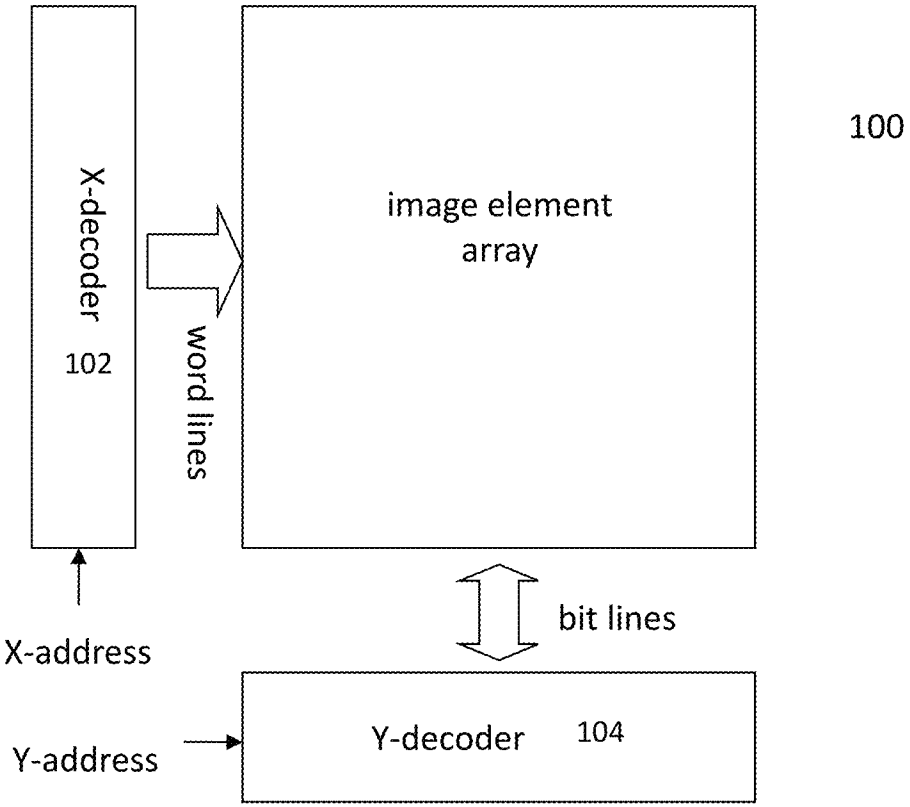
FIG. 1 shows an example of a display device to show how image elements are addressed.

Referring now to the drawings, in which like numerals refer to like parts throughout the several views. FIG. 1 shows an example of a display device 100 to show how image elements are addressed. As is the case in most memory cell architecture, image elements or pixels are best accessed via decoding a sequence of pre-determined address bits to specify the location of a target image element. These predetermined address bits are further divided into X-address bits and Y-address bits. The X-address bits decode the location of control line (word line) of an image element while the Y-address bits decode the location of data line (bit line) of the image element. The set of circuits that decode the X-address bits into selected control lines (word lines) is called horizontal decoder or X-decoder 102. The set of circuits that decode Y-address bits into selected data lines (bit lines) is called vertical decoder or Y-decoder 104.

In general, there are two driving methods, analog and digital, to provide a gray level to each of the image elements. As used herein, gray or a gray level implies a brightness or intensity level, not necessarily an achromatic gray level between black and white. For example, a red color is being displayed, in which case a gray level of the color means how much red (e.g., a brightness level in red) to be displayed. To facilitate the description of the present invention, the word gray will be used throughout the description herein. In the analog driving method, the gray level is determined by a voltage level stored in a storage node. In the digital driving method, the gray level is determined by a pulse width modulation (PWM), where the mixture of an ON state voltage duration and an OFF state voltage duration results in a gray level through the temporal filtering of human eyes. To increase the intensity resolution of the display device 100, for better picture quality, both of the analog and digital methods have limitations in increasing the resolution in intensity.

With analog driving method, one gray level is often limited to a minute swing of voltage range, usually in mV range, which makes the gray level sensitive to any source that can cause a voltage level to change. Such exemplary sources include leakage currents of MOS transistors and switching noise. In order to overcome such issues and extend the voltage tolerance on a gray level, LCoS micro-display manufacturers often resort to high voltage process technologies instead of taking advantage of the general logic process. The use of high voltage devices, in turn, limits the size of an image element. In addition, the analog driving method is prone to manufacturing process parameter mismatch, both inside the chip and from chip to chip.

On the other hand, the digital driving method relies on pulse width modulation (PWM) to form an equivalent gray level accumulatively. This process needs to write data to the image elements several times. The gray level resolution is bounded by the minimal time duration that the liquid crystal can respond to. As a result, users of the digital driving scheme often look for liquid crystals with fast response time to overcome the limitation.

Most of digital pixel drive schemes control the width of a single pulse of a fixed amplitude output from each pixel during a frame period (Single Pulse Width Modulation, or S-PWM), a sequence of identical individual pulse from each pixel during a frame period (Count-based Pulse Width Modulation, C-PWM), or a sequence of binary-weighted-in-time individual light pulses from each pixel during a frame period (Binary-Coded Pulse Width Modulation, or B-PWM). The use of time domain digital modulation assumes that the electro-optical response of LC responds to the RMS drive signals, allowing an analog electro-optical response to be controlled by the duty cycle of a square wave as in B-PWM, or a sequence of binary-weighted square waves as in C-PWM.

According to one embodiment of the present invention, a sub-image element approach is used to achieve what is referred herein as a hybrid driving scheme, namely some are driven using the digital driving method and others are driven by the analog driving method. When dividing an image element (a.k.a., a pixel) into sub-pixels of equal size, for example, $2^n$ sub-pixels are sufficient to produce $2^n$ gray levels or n-bit grayscale. When an image element is divided into an array of smaller and, perhaps, identical image elements (i.e., sub-image elements), the array may have one or more rows of sub-image elements and one or more columns of sub-image elements. Each sub-image element can be independently programmed through their associated control lines and data lines.

These sub-image elements are driven by PWM as in digital modulation. Human eyes serve as a temporal filter as well as a spatial filter to an image or video. Turning on brightening a portion of an image element area has the same perceived effect of turning on or brightening an image element for a particular time. As the resolution of PWM is limited to the liquid crystal response time, modulating a portion of an image element area provides finer gray levels beyond what is currently available in digital modulation. In other words, image elements with sub-image elements increase the spatial resolution to break the limitation in the temporal intensity resolution due to the liquid crystal response time.

Figures 2, 2A:
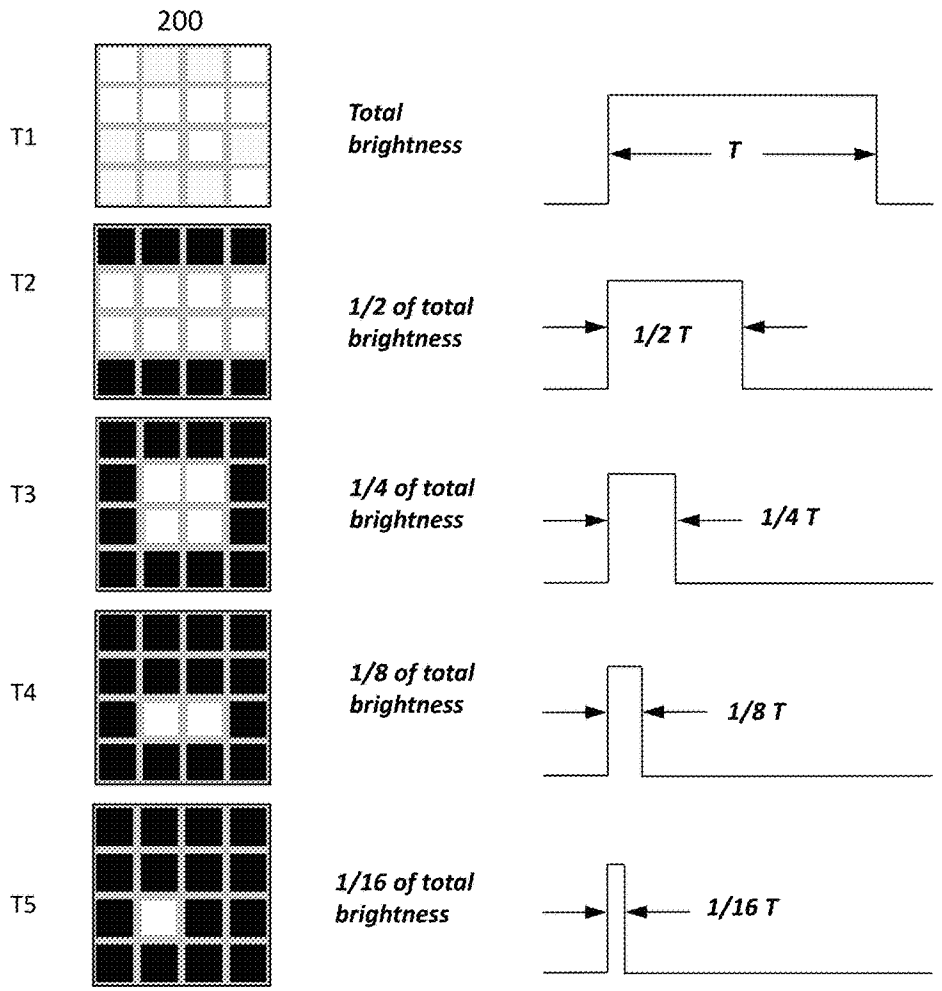
FIG. 2A illustrates graphically the concept of brightness equivalence between PWM and SAM.

The process of modifying the ON state and OFF state of sub-image elements to generate additional gray levels is referred to herein as "spatial area modification" (SAM). FIG. 2A illustrates graphically the concept of brightness equivalence between PWM and SAM. As fast responding liquid crystal material may not have all the characteristics suitable for applications, adopting the SAM modulation can widen the material selection to a broader range of liquid crystals. In addition, the SAM modulation can always achieve a fraction of minimal PWM modulation brightness. FIG. 2A shows that an image element includes an array of smaller and identical image elements (sub-image elements). Each of the sub-image elements can be independently programmed through their associated control lines and data lines.

In the conventional PWM digital modulation, the complete array of image elements can only be programmed with data of the same gray level weighting. Data of different gray level weighting needs another update of entire plane (e.g., all elements in the array are refreshed). The cumulative effect of multiple plane updates with different gray levels produces a desired overall gray level.

In FIG. 2A, an element 200 has 16 sub-image elements, all of which are driven to be ON entirely at T1, which is equivalent to a full brightness (white). On the other side, the element 200 is driven to be OFF entirely at another time (not shown), which is equivalent to a full darkness (black). When some of the sub-image elements in the element 200 are turned on (i.e., ON) or off (i.e., OFF) at different times (e.g., T2, T3, T4 or T5), resulting in various gray levels. All of the perceived gray levels are corresponding to what a single image element could produce when controlled by the PWM digital modulation.

Figures 2B, 2C:
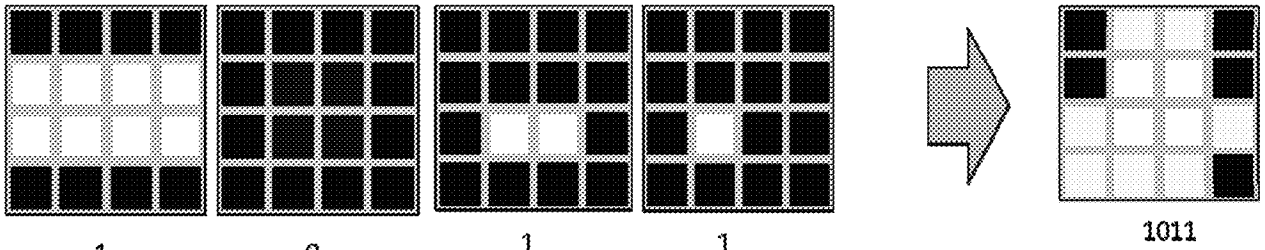
FIG. 2B shows that, for the SAM modulation, gray levels of sub-image elements can be written with one plane update.
FIG. 2C lists the number of patterns available for the same binary weighed gray level for a 4×4 sub-image element array.

FIG. 2B shows that, according to one embodiment, for the SAM modulation, gray levels of sub-image elements can be written with one plane update. As programming a gray level of 1011 to an image element with 4×4 sub-image elements would require turning on 11 sub-image elements as: 1×(8 sub element)+0×(4 sub element)+1×(2 sub elements)+1×(1 sub element)=11 sub-elements. Thus it can be concluded that any pattern with 11 sub-elements turned on can match the gray level. According to one embodiment, instead of writing sequentially with 4 plane updates, the gray level in the SAM modulation can be written with one plane update.

The examples in FIG. 2A and FIG. 2B both imply a linear relationship between the area of image element and the perceived brightness. It may not be the case in reality. As the pulse width of spatial density modulation is still limited to the response time of the liquid crystals, the responding rise and fall time of the liquid crystals may produce a brightness level not necessarily proportional to the percentage of the area being turned on. According to one embodiment, a lookup table is provided to cross-reference a target gray level versus the number of sub-image elements.

When the image element does not require full brightness or full darkness, there is more than one pattern of sub-image element array that can satisfy the required number of sub-image elements. FIG. 2C lists a table showing the number of patterns available for the same binary weighed gray level for a 4×4 sub-image element array. There are many ways of determining the corresponding location of sub-image elements to the binary weights and gray levels.

Fixed location: the number and location of sub-elements corresponding to a specific gray level are fixed. This is the easiest way of implementing the spatial area modulation.

Rotation: for each binary weighed gray level, a certain number of patterns are selected. These patterns follow a pre-determined sequence to be the pattern of sub-element array for a specified gray level. In video or images, an area with no or little gray shade difference can result in contour artifact. Rotating the pattern of a sub-element array reduces the effect as the image never "sticks" while showing the same gray level. The number of patterns depends on their availability as well as the limitation in implementation. Implementation can be done through the use of a look-up table or a state machine to scramble through the patterns.

Random Selection: each binary weighed gray level has a certain number of patterns to display. However, the pattern of sub-element array for the gray level is randomly chosen. This scheme has the benefit of further reducing the contour issue as even neighboring image elements can display different patterns while showing the same gray level. The number of patterns depends on their availability as well as the limitation in implementation. An exemplary implementation is the use of a look-up table with a random pointer or a state machine to randomly choose the patterns.

Algorithms: with a determined number of sub-image elements for the gray level, the pattern of the array is generated through a pre-determined computational algorithm. The algorithm can take into account of multiple purposes: lateral liquid crystal fringing field, patterns of surrounding image elements, compensation of gray level digitization. It can be implemented with several image processing techniques, such as image enhancement, image sharpening, motion estimation motion compensation (MEMC). It can also utilize skills like digital halftoning or error diffusion commonly used in printing. The details of the algorithms are not to be further described to avoid obscuring aspects of the present invention.

According to one embodiment, when display with additional gray levels is not needed, the sub-image element array is treated as just one image element. All the sub-image elements receive the same data simultaneously. As the sub-image elements are uniform, it can be treated as down-scaling the resolution. For example, a display with 1920×1080 image elements with each element containing 2×2 sub-element array can also be viewed as a display with 3840×2160 image elements, i.e., all the sub-element are now promoted to an independent element. As will be further described below, this feature is used to double the display resolution of an input image according to one embodiment of the present invention. In other words, when an input image is of resolution in 1920×1080, a processor is designed to generate a shifted image in the same resolution 1920×1080. Through a shift by one sub-pixel, the second (shifted) image is displayed by one sub-pixel shift at a twice refresh rate to double the perceived spatial resolution of the input (first or original input image).

As described above, a display device or microdisplay with an array of image elements can be scaled down in resolution as an array of a lower resolution microdisplay when a plural number of rows and columns of sub-image elements in each image element are merged, or turned on or off simultaneously. For example, a microdisplay can be treated as having m rows of image elements and n columns of image elements with each image element having a rows of sub image elements and b columns of sub-image elements, provided that the native image element array has m×a rows and n×b columns, where numbers, a, b, m, and n are positive integers.

When the display resolution is scaled down, video inputs to the display are scaled down accordingly. All sub-image elements of an image element are treated as part of the image element and therefore would be programmed to be read out as an identical (or averaged) gray value simultaneously. All the control lines associated to a rows of sub image elements need to be selected simultaneously and all the data lines associated to b columns of sub image elements need to be selected simultaneously as well.

Referring back to FIG. 1, the X-decoders 102 provided to select the control lines of the rows and the Y-decoders 104 provided to select the data lines of the columns need to be modified accordingly. In this case, the X-address bits are divided into two parts: low order X-address bits and high order X-address bits. It is assumed that the number of X-address bits required to decode the control lines are u bits, and denoted u-1, u-2, 1, 0, with address 0 being the lowest order bit. The low order X-address bits are i-1, i-2, . . . , 1, 0, such that $2^i$=a if a is a power of 2, or i is the minimum integer satisfying $2^i$>a if otherwise. As a result, there are u-i bits of high order X-address bits and denoted u-1, u-2, . . . , u-i. The X-decoder is divided into two parts as well: the low order X-decoder that decodes with low order bits i-1, i-2, . . . , 1, 0, and the high order X-decoder that decodes with high order bits u-1, u-2, . . . , u-i.

Similar approaches can be done with the Y-address bits. It is assumed that the number of Y-address bits required to decode the data lines are v bits, and denoted v-1, v-2, . . . , 1, 0, with address 0 being the lowest order bit. The low order Y-address bits are j-1, j-2, . . . , 1, 0, such that $2^i$=b if b is a power of 2, or j is the minimum integer satisfying $2^i$>b if otherwise. As a result, there are v-j bits of high order Y-address bits and denoted v-1, v-2, . . . , v-j. The Y-decoder is divided into two parts as well: the low order Y-decoder that decodes with low order bits j-1, j-2, . . . , 1, 0, and the high order Y-decoder that decodes with high order bits v-1, v-2, . . . , v-j.

When the display resolution is down scaled to a lower resolution, decoding from the low order address bits is not needed. By applying a control signal, DownScale, to force the outputs of low order decoder to be logic "1", all the control lines of the target image element are selected.

Given a display device with the proposed sub-image elements, a corresponding driving method shall be used to take the advantage of the architecture. As described above, either one of the digital driving method and analog driving has its own limitations. According to one embodiment of the present invention, a mixed use of the digital driving method and analog driving method, referred to herein as a hybrid driving scheme, is proposed to address the limitations in both digital drive scheme and analog drive scheme. It is assumed that a display device is provided to display n-bit gray scale. The n-bit gray scale is first divided into two parts. The m most significant bits (MSB) of the n-bit gray scale form a group to generate $2^m$ of distinct voltage levels between two voltages, for example, a high voltage $V_H$ and a low voltage $V_L$. These distinct voltage levels are denoted as $V_0$, $V_1$, $V_2$, . . . $V_{2^m-1}$ respectively, with $V_0$=VL and $V_{2^m-1}$=VH. Similar to the analog drive scheme, these voltage levels can be generated from a digital-to-analog converter (DAC). The remaining n-m bits of gray scale are implemented with $2^{n-m}$ pulses of equal duration in one frame, similar to Count-based Pulse Width Modulation (C-PWM) in digital drive scheme. However, unlike the C-PWM modulation, these pulses do not produce $V_H$ amplitude for logic "1" pulses. Instead, these $2^{n-m}$ pulses have an amplitude of $V_h$ for logic "1" pulses, where $V_h$ is a voltage level selected from $V_0, V_1, V_2, \ldots V_{2^m-1}$ voltage levels by the m-bit MSB group. $V_h$ represents the voltage possible for a targeted gray level.

Figure 3A:
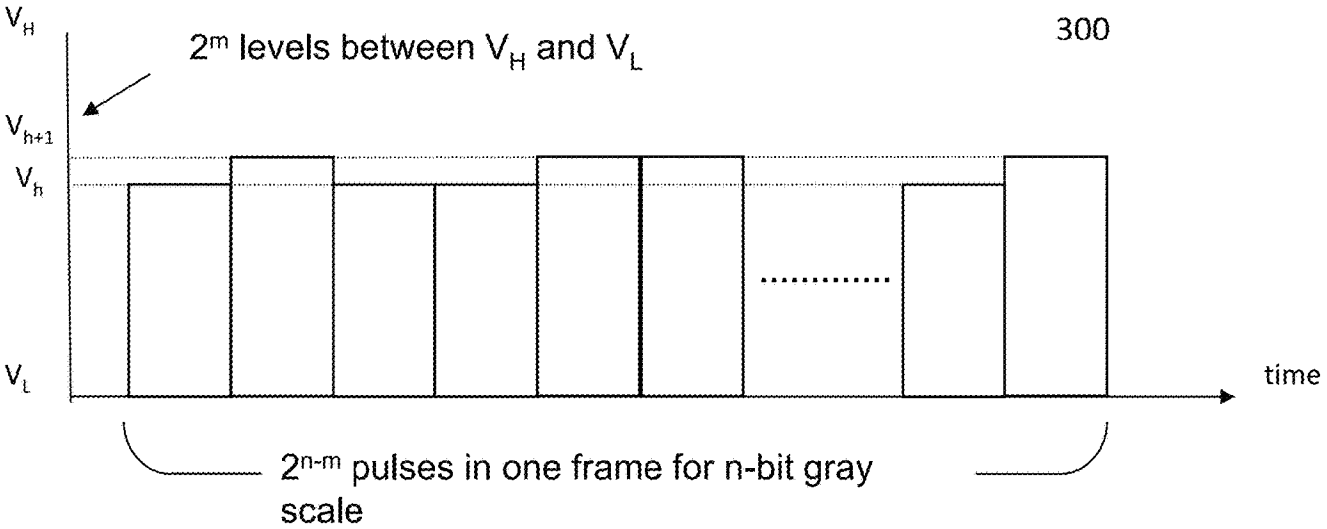
FIG. 3A illustrates an exemplary waveform of a storage node in a pixel element when this hybrid driving scheme is applied.

According to one embodiment, FIG. 3A illustrates an exemplary waveform of a storage node in a pixel element when this hybrid driving scheme is applied to. It can be noted that it only takes m bit per pulse to generate the amplitude $V_h$ for logic "1" pulses. The total number of data bits required for one pixel per frame to complete the $2^n$ gray scale modulation is $m \times 2^{n-m}$. In comparison, a pure C-PWM scheme requires $2^n$ pulses with 1 bit per pulse to distinguish logic "0" pulses and logic "1" pulses. A total of $2^n$ bits per pixel per frame are needed. Assigning more bits to the MSB group greatly reduces the total bit count needed to implement the n-bit gray scale, gradually approaching the bit count of an analog drive scheme.

Reducing the bit count per frame can either reduce the power consumption by slowing down the operating frequency, or increase the gray scale with the same power budget. As pulses are part of the modulation scheme, the refresh rate to the storage node is considerably higher than what is necessary in the analog driving scheme. A high refresh rate reduces the voltage variation to the storage node when in high impedance state.

Any pixel in an array toggles only between one voltage level and its adjacent voltage level. As to the digital modulation in C-PWM, the voltage on a storage node changes between $V_H$ and $V_L$. The reduced voltage swing greatly minimizes the digital switching noise. The magnitude of switching noise reduces with the amplitude. Thus, a dark area has minimal noise.

Figure 3B:
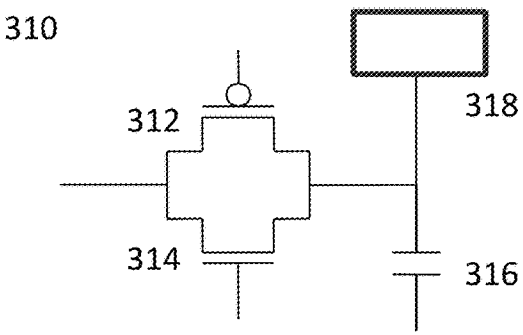
FIG. 3B shows a new cell 310 that is so designed to perform both digital and analog pixel driving scheme (a.k.a., hybrid driving method)

According to one embodiment of the present invention, FIG. 3B shows a new cell 310 that is so designed to perform both digital and analog pixel driving scheme (a.k.a., hybrid driving method). It includes two MOS transistors 312 and 314, one being p-typed MOS transistor (PMOS) and the other being n-typed MOS transistor (NMOS). One of the NMOS diffusion terminals (source or drain) is tied to one of the PMOS diffusion terminals (source or drain). This common diffusion terminal is then coupled or connected to a line that is common to all pixels in a column of an image element array. This common line to all elements in a column is usually referred as a bit line. The other NMOS diffusion terminal is also tied to the other diffusion terminal of PMOS and coupled to the internal storage node of the element, where a storage element 316 (e.g., a capacitor) resides. The storage node 318 is coupled to or connected to a metal (e.g., aluminum) electrode that biases the liquid crystal in the cell. The gate of the NMOS transistor is connected to a bus line that is common to the gate of NMOS transistors of all pixels in a given row of a pixel array. The gate of the PMOS transistor is connected to another bus line that is common to the gate of PMOS transistors of all pixels in a given row of a pixel array. The bus line connecting the gate of NMOS transistors of all pixels in a given row of a pixel array is referred to as NMOS word line, the bus line connecting the gate of PMOS transistors of all pixels in a given row of a pixel array is referred to as PMOS word line.

The formation of one NMOS transistor and one PMOS transistor with both ends of terminals tied together forms a transmission gate that can selectively block or pass a signal level from one terminal to the other terminal. When the gate of NMOS transistor is applied a high voltage level (usually denoted as logic "1"), the complementary low voltage level (denoted as logic "0") is applied to the gate of PMOS transistor, allowing both transistors to conduct and pass the signal from one terminal to another. When a low voltage level (logic "0") is applied to the gate of NMOS transistor and a high voltage level (logic "1") is applied to the gate of PMOS transistor, both transistors turn off and there is no conduction path between the two terminals of the transmission gate. The internal storage node is said to be in high impedance state. The voltage level of the internal storage node remains the same as the storage element retains the electrical charge.

One of the benefits, objects and advantages of the cell architecture of FIG. 3B is Cancelling Coupling Effect, Balanced ON Resistance for different Voltage Level, Compact Design and Full Voltage Swing.

Cancelling Coupling Effect: the gate polarity of an NMOS transistor is opposite to the gate polarity of a PMOS transistor. Changing the gate of the NMOS transistor from a low voltage level to a high voltage level forms a conduction path between two diffusion terminals of the NMOS transistor. Changing the gate of a PMOS transistor from a high voltage level to a low voltage level forms a conduction path between two diffusion terminals of the PMOS transistor. Likewise, changing the gate of an NMOS transistor from a high voltage level to a low voltage level turns off the conduction path between two diffusion terminals of the NMOS transistor. Changing the gate of a PMOS transistor from a low voltage level to a high voltage level turns off the conduction path between two diffusion terminals of the PMOS transistor. When turning off the MOS transistors, signals switching at the gate of a MOS transistor can alter the amount of electric charge stored at the diffusion terminal through the parasitic capacitance between the gate and the diffusion terminal. Changing stored electric charge changes the voltage level on the internal storage node. The proposed pixel cell has an NMOS transistor and a PMOS transistor to form a transmission gate. The opposite gate polarity can cancel out the coupling effect as the coupling from the NMOS transistor offsets the coupling from the PMOS transistor.

Balanced ON Resistance for different Voltage level: a line that is common to all pixels in a column of the pixel array. The gate of the MOS transistor is connected to a bus line that is common to all pixels in a given row of a pixel array. One of its two diffusion terminals (source or drain) is connected to a line that is common to all pixels in a column of the pixel array. The other diffusion terminal connects to the internal storage node of the pixel.

Compact Design: the proposed pixel cell contains only three components, one NMOS transistor, one PMOS transistor, and one capacitor. As will be seen in the proposed hybrid drive method, high voltage and high voltage transistors are not needed to counter the noise issue in analog drive scheme, transistors from general logic process technology can meet the design requirement. We can utilize advanced process technologies to create a pixel cell taking up minimal area. A compact pixel cell creates the possibility of spatial drive scheme. An important factor for sub-pixelation is that the sub-pixel areas should be too small to be visually resolved by the observer.

Full Voltage Swing: the advantage of the CMOS transmission gate compared to the NMOS transmission gate used in an analog pixel cell is to allow the input signal to be transmitted fully to the internal storage node without the threshold voltage attenuation.

Figure 4:
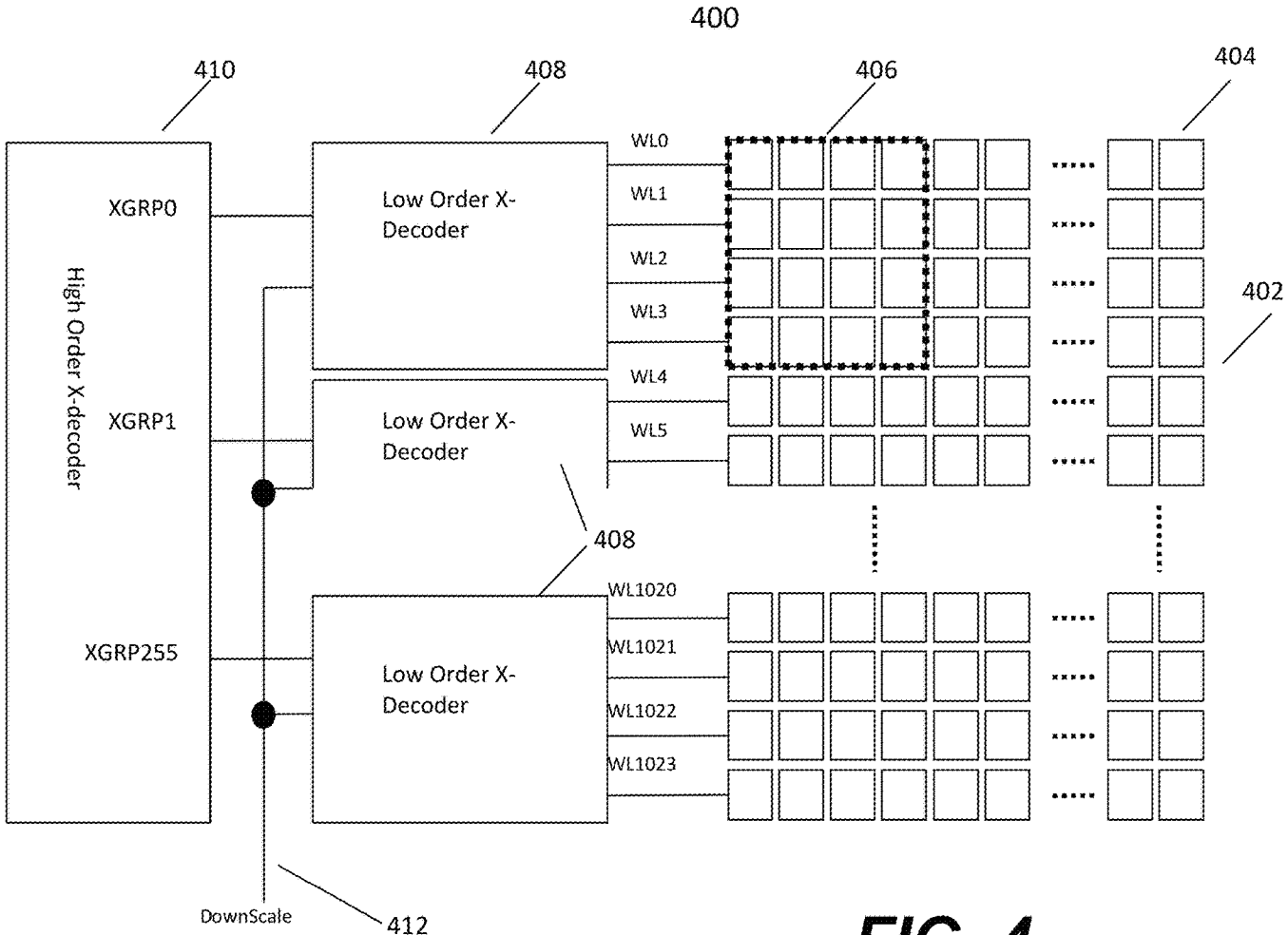
FIG. 4 shows a block diagram of an implementation when the number of rows and columns of the sub-image elements in an image element are in the power of 2.

Referring now to FIG. 4, it shows a block diagram 400 of an exemplary implementation of an image element being divided into a plurality of sub-image elements, where the number of rows a is to the power of 2. In this case, a=4 and thus l=2. An array 402 of image elements has 1024 control lines as denoted from WL0 to WL1023. Reference 404 indicates each of the image elements has one control line and one data line. Reference 406 is an image element when the display is scaled down to a lower resolution. In this case, each of the image elements has a 4×4 sub-image elements. Accordingly, each of the image elements has four control lines and four data lines. A low order X-address decoder 408 is designed to generate 4 distinct control lines, WL3, WL2, WL1, and WL0. A high order X-address decoder 410 is designed to determine which one of the low order X-address decoders is selected. In embodiment, a scale down control signal 412 is provided to disable the low order X-decoder if the control signal 412 is logic "1", or enable the low order X-decoder if the control signal 412 is logic "0".

Figure 5:
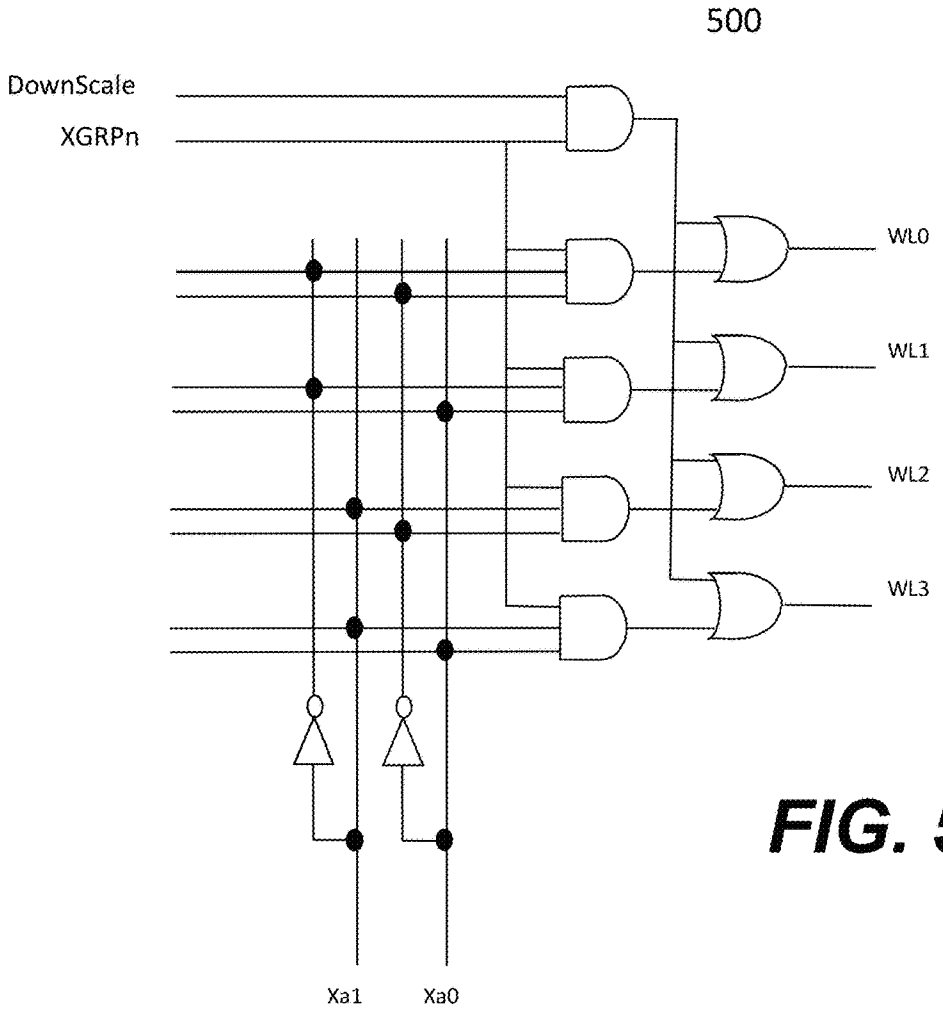
FIG. 5 shows one exemplary implementation of a low order X-decoder that may be used in FIG. 4.

When a low order X-decoder is disabled, the output control lines are logic "1" if the low order X-decoder is selected by high order X-decoder; the output control lines are logic "0" if the low order X-decoder is not selected by high order X-decoder. FIG. 5 shows one exemplary implementation 500 for the low order X-decoder that may be used in FIG. 4.

Figure 6:
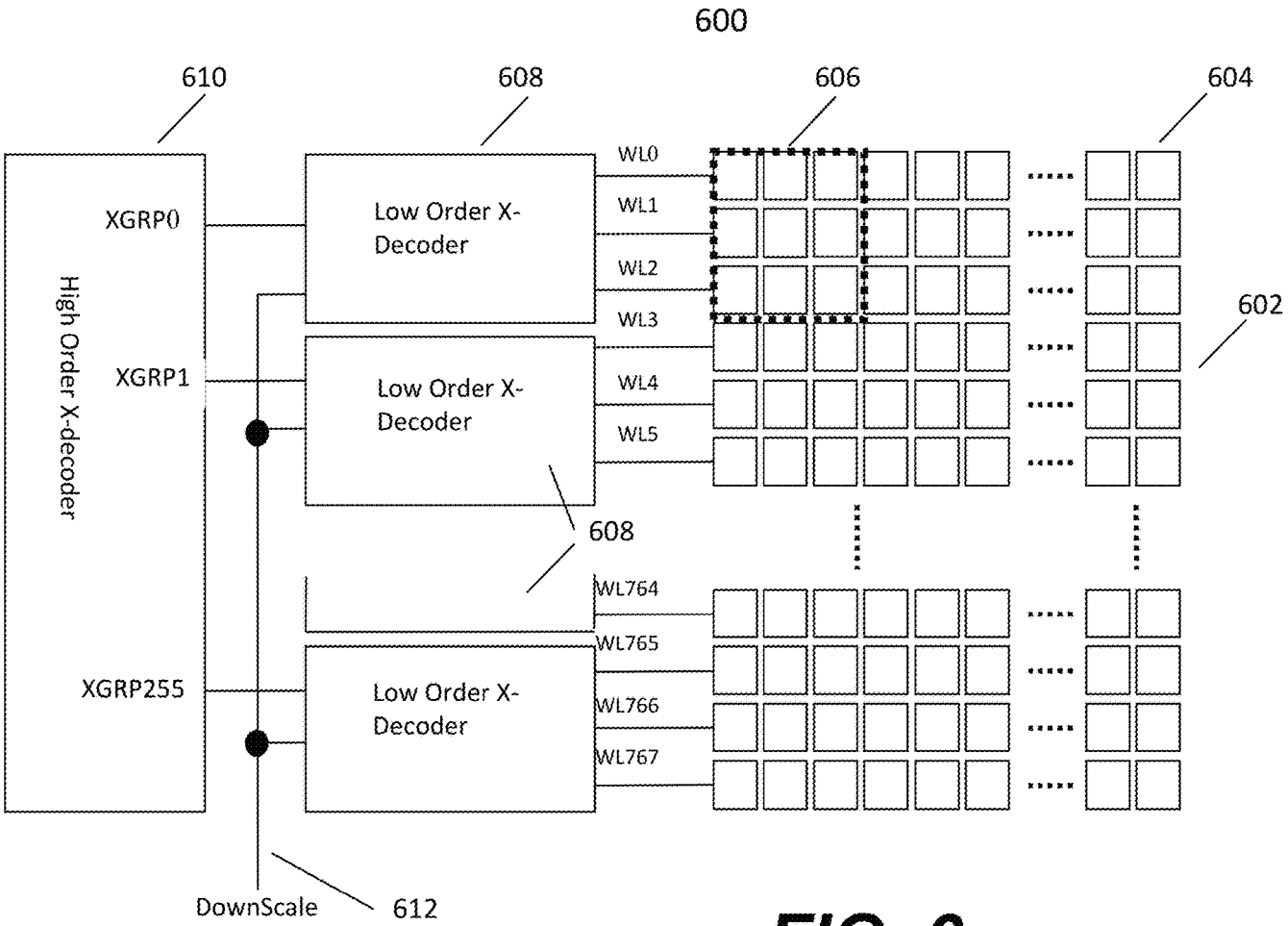
FIG. 6 shows an example of block diagram of an implementation when the number of rows or columns of the sub-image elements in an image element is 3.

Similar implementation can be done when a is not to the power of 2. FIG. 6 shows an example of block diagram 600 of such an implementation when the number of rows a is 3. In this case, l=2. an array 602 of image elements has 768 control lines as denoted from WL0 to WL767. Each of the image elements 604 has one control line and one data line. Reference 606 shows an image element when the display is scaled down to a lower resolution. In this case, the image element has 3×3 sub-image elements. Accordingly, one image element has three control lines and three data lines. Reference 608 indicates a low order X-address decoder that generates 3 distinct control lines, WL2, WL1, and WL0. Reference 610 indicates a high order X-address decoder that determines which one of the low order X-address decoder is selected. In embodiment, a scale down control signal 612 is provided to disable the low order X-decoder if the scale down control signal 612 is logic "1", or enable the low order X-decoder if the scale down control signal 612 is logic "0". When a low order X-decoder is disabled, the output control lines are logic "1" if the low order X-decoder is selected by high order X-decoder; the output control lines are logic "0" if the low order X-decoder is not selected by high order X-decoder. One implementation for the low order X-decoder may be done substantially similar to FIG. 5.

Figure 7B:
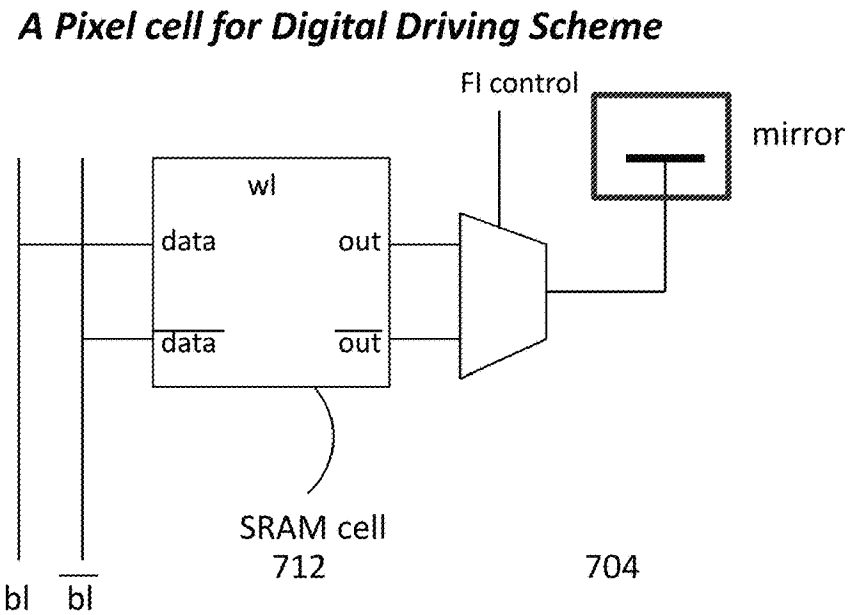
FIGS. 7A and 7B show respectively two functional diagrams for the analog driving method and digital driving method.
Figure 7A:
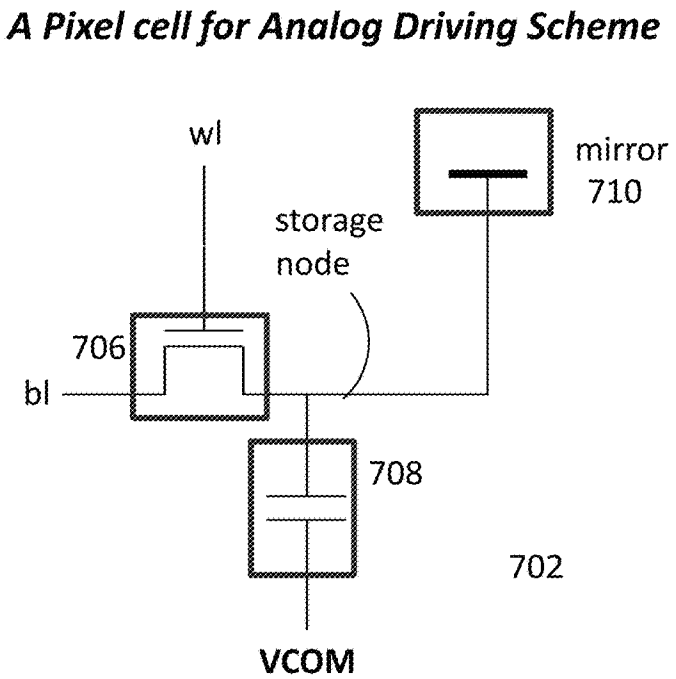

In general, there are two ways to feed video signals to the image elements: analog driving method and digital driving method. Referring now to FIG. 7A and FIG. 7B, two functional diagrams 702 and 704 for the analog driving method and digital driving method are shown. For the analog driving scheme, one pixel includes a pass device 706 and one capacitor 708, with a storage node connected to a mirror circuit 710 to control a corresponding liquid crystal. For the digital driving method, pulse width modulation (PWM) is used to control the gray level of an image element. A static memory cell 712 (e.g., SRAM cell) is provided to store the logic "1" or logic "0" signal periodically. The logic "1" or logic "0" signal determines that the associated element transmits the light fully or absorbs the light completely, resulting in white and black. A various mixture of the logic "1" duration and the logic "0" duration decides a perceived gray level of the element.

The advancement of display technology requires packing ever more image elements into a microdisplay (e.g., LCoS) for higher resolution image quality. The size of a digital pixel cell is limited by the SRAM cell and associated circuits therefor. FIG. 8A shows a functional block diagram 800 of an image element according to one embodiment of the present invention. A node 802 controls the state of a pass device 804. When the device 804 is at ON state, a signal at node 806 is propagated to a node 808. When the device 804 is at OFF state, there is no relationship between the nodes 806 and 808. Data stored at the node 808 is held up by a storage device 810. The node 812 is a source node for a pull-up device 814 while the node 818 is a source node for a pull-down device 820. In one embodiment, the node 812 is connected to the highest voltage level appropriate to a mirror metal plate 816, and the node 818 is connected to the lowest voltage level appropriate to the mirror metal plate 816. The pull-up and pull-down devices 814 and 820 form a buffer stage, both are controlled by the state of the node 808 with opposite polarity. Namely, when the device 814 is at ON state, the device 820 is at OFF state, an output node 824 is sourced from the node 812. When the device 820 is at ON state, the device 814 is at OFF state, the output node 824 is sourced from the node 818.

Figure 8B:
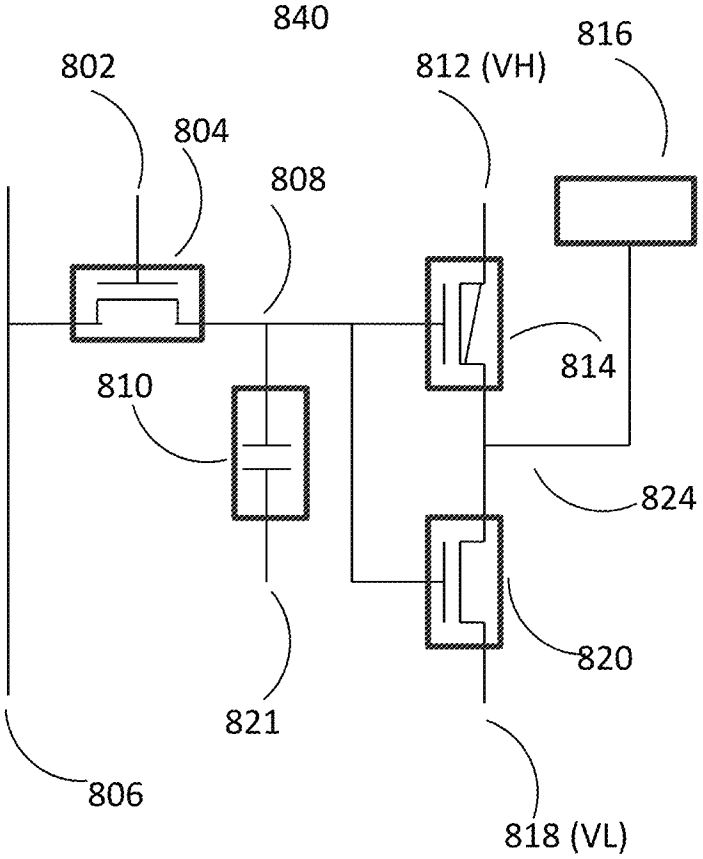
FIG. 8B shows an exemplary implementation of the block diagram of FIG. 8A in CMOS.
Figure 8A:
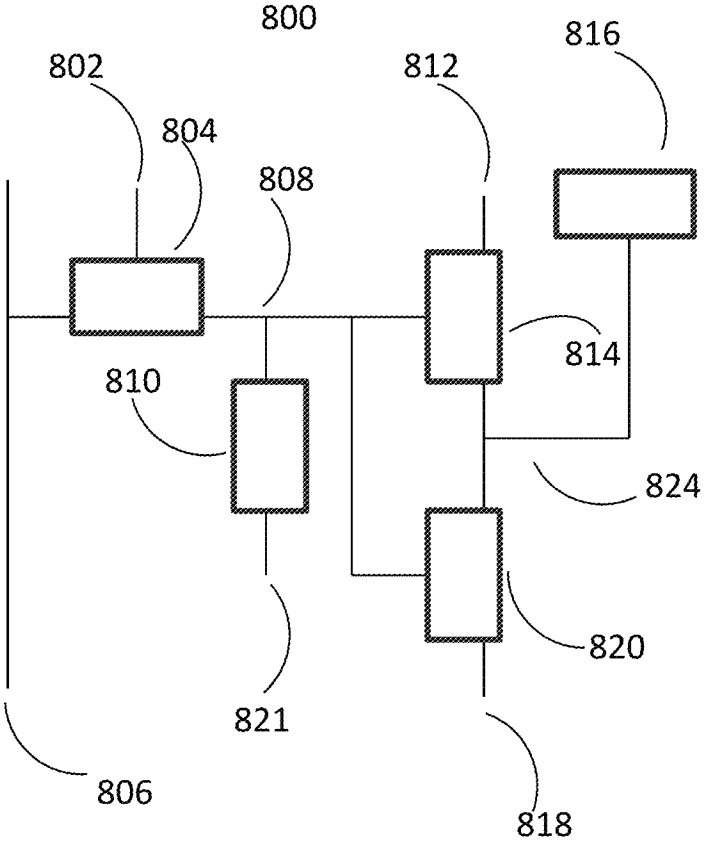
FIG. 8A shows a functional block diagram of an image element according to one embodiment of the present invention.

FIG. 8B shows an exemplary implementation of the block diagram 800 of FIG. 8A in CMOS. According to one embodiment, NMOS is assigned to the pass device 804. PMOS is assigned to the pull-up device 814. NMOS is assigned to the pull-down device 820. The storage device 810 can be a capacitor, including MOS gate capacitor, MIM capacitor, or deep trench capacitor. V1 is assigned to the node 812, where V1 is the highest voltage suitable to the mirror plate 816. V0 is assigned to the node 818, where V0 is the lowest voltage suitable to the mirror plate 816. The nodes 806 and 802 are the data node and control node for the pass device 804, respectively, and toggle between VH and VL. In one embodiment, VH is the voltage level for logic "1" state and VL is the voltage level for logic "0" state.

Figure 9B:
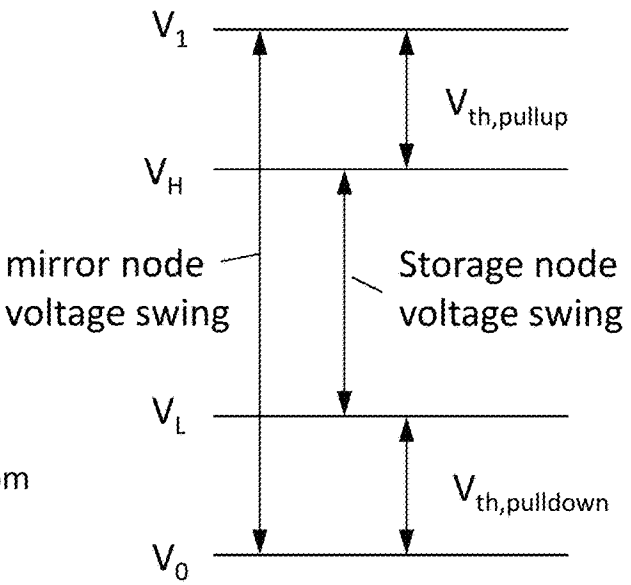
FIG. 9B shows that a pull-up device remains non-conducting as long as $|V_{th,pullup}|>V_1-V_H$ and a pull-down device remains non-conducting as long as $V_{th,pulldown}>V_L-V_0$.
Figure 9A:
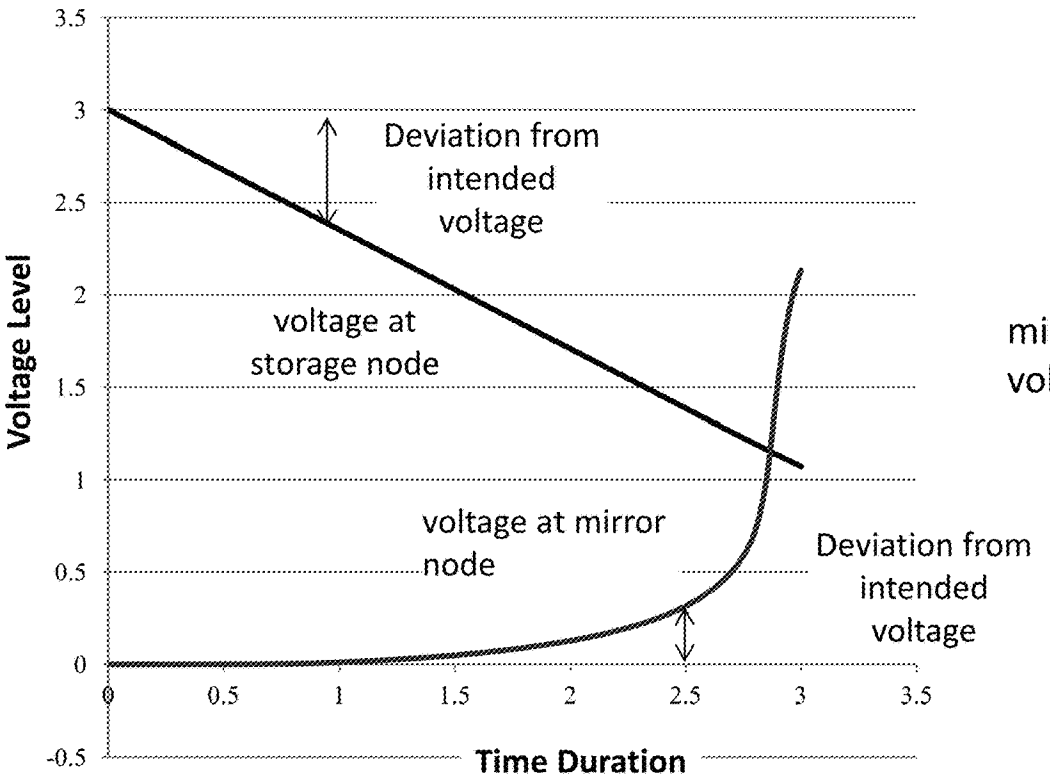
FIG. 9A shows an implementation greatly extending the duration of a valid signal and removing the need of refresh operation.

The implementation of FIG. 8B constructs an inverting image element pixel cell. The devices 814 and 820 form an inverter as well as an output buffer. A VH (logic"1") state at a data node being programmed to the storage node 808 results in a display of low voltage V0 at the mirror plate 816. A VL (logic"0") state at a data node being programmed to the storage node 808 results in a display of low voltage V1 at the mirror plate 818. The inverting output buffer digitizes the signal stored at the node 808. As a result, the gradual voltage variation due to leakage current through diffusion and channel of the pass device 804 are filtered out. The mirror plate 816 sees a solid V1 or V0 even with deteriorating internal storage voltage level. This implementation greatly extends the duration of a valid signal and removes the need of refresh operation as shown in FIG. 9A.

According to one embodiment, the voltage on the control node of MOS devices needs to exceed the minimal voltage, a threshold voltage, in order to switch the device from OFF state to ON state. Likewise, the voltage on control node of MOS devices needs to be less than the threshold voltage in order to switch the device from ON state to OFF state. The threshold voltage of the pull-up and pull-down devices (e.g., 814 and 820 of FIG. 8A or 8B) allows the maximal voltage swing on the mirror plate (the difference between V1 and V0) to be different from the voltage swing on the storage node 808 (the difference between VH and VL).

The pull-up device 814 remains non-conducting as long as $|V_{th,pullup}|>V_1-V_{storage(max)}$. The pull-down device 820 remains non-conducting as long as $V_{th,pulldown} > V_{storage(min)} - V_0$. As shown in FIG. 9B, the pull-up device remains non-conducting as long as $|V_{th,pullup}| > V_1 - V_H$, the pull-down device remains non-conducting as long as $V_{th,pulldown} > V_L - V_0$. According to one embodiment, selecting high threshold voltage devices as devices 814 and 820 can increase the time when voltage of mirror plate remains constant and reduces the liquid crystal response time requirement in LCoS, as shown in FIG. 9B.

The threshold voltage of the device can limit the maximal or minimal voltage level to the storage node 808 due to the body effect of MOS devices. For NMOS type pass device, the maximal voltage level can pass from data node to storage node and is limited to $V_{control} - V_{th,pass}$, where $V_{th,pass}$ is the threshold voltage of NMOS device. For PMOS type pass device, the minimal voltage level can pass from data node to storage node and is limited to $V_{th,pass}$, where $V_{th,pass}$ is the magnitude of threshold voltage of PMOS device. For NMOS type pass device, increasing the control node voltage level to $V_{control} > V_H + V_{th,pass}$ assures to full passage of $V_H$ voltage. For PMOS type pass device, reducing the control node voltage level to $V_{control} < V_L - V_{th,pass}$ assures to the full passage of $V_L$ voltage.

Figure 10B:
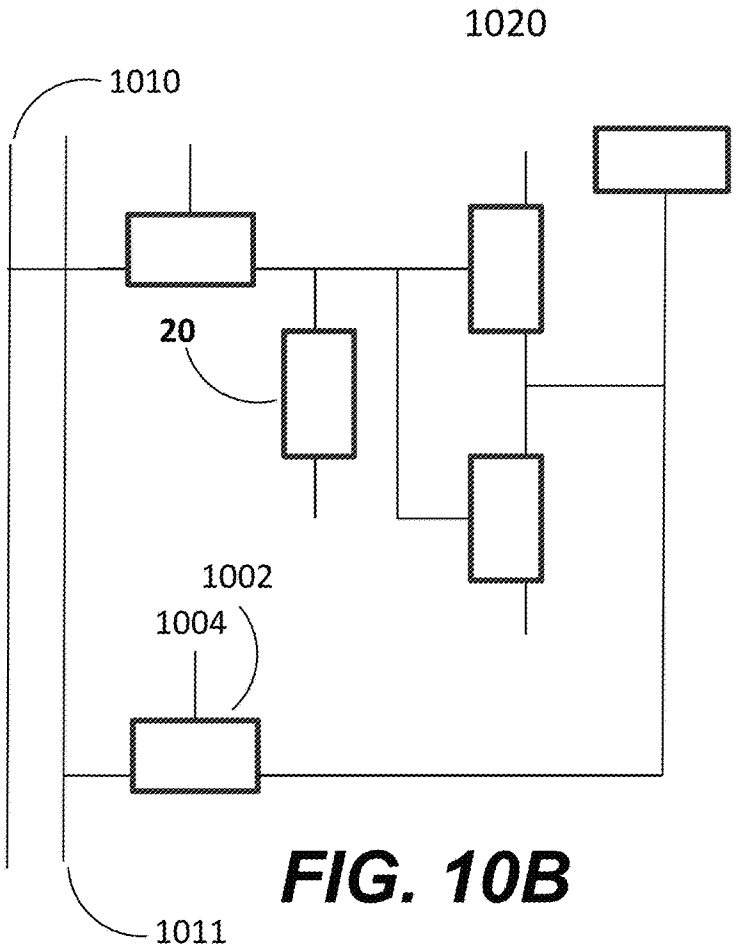
FIG. 10B shows that a data node is removed from a read pass device and replaced with another data node.
Figure 10A:
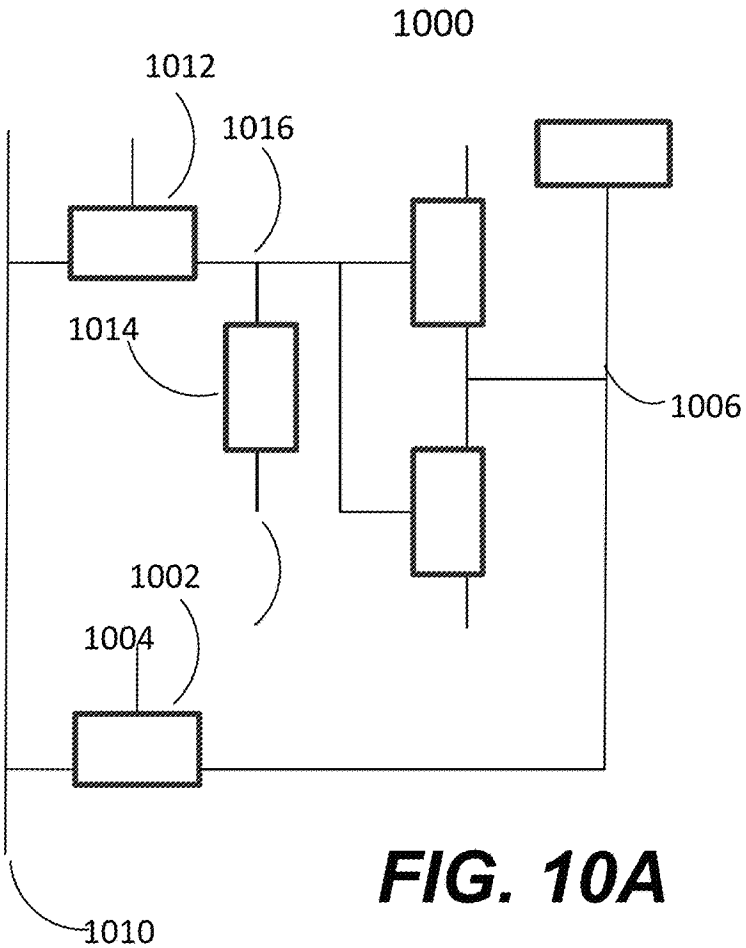
FIG. 10A shows one embodiment of a pixel with read back operations.

Referring now to FIG. 10A, it shows one embodiment 1000 of a pixel with read back operations. A pass device 1002 (read pass device) is coupled to a control node 1004, with a source node 1004 thereof connected to a buffer output node 1006, and the other end 1008 thereof to a data node 1010. For the read back operation, with a device 1012 at OFF state and the switching device 1002 to ON state, the signal at the node 1006 is propagated to the data node 1010. A sensing circuit (not shown) is designed to detect the state of the storage node 1014 by reading the state of the signal at the data node 1010. The read back operation is non-destructive to the charge stored in the storage node 1016, while providing a strong voltage level for logic "1" and a logic "0".

According to one embodiment as shown in FIG. 10B, the data node 1010 is removed from the device 1002 (read pass device) and replaced with a data node 1011. Hence the data node 1010 is now a dedicated node for write operation while the data node 1011 is a dedicated node for read operation. Accordingly, the write and read operations can take place concurrently and independently. This embodiment provides an efficient way to characterize the timing of write operation by concurrently validating the read back data, where read back data is complement of write data.

Figure 11:
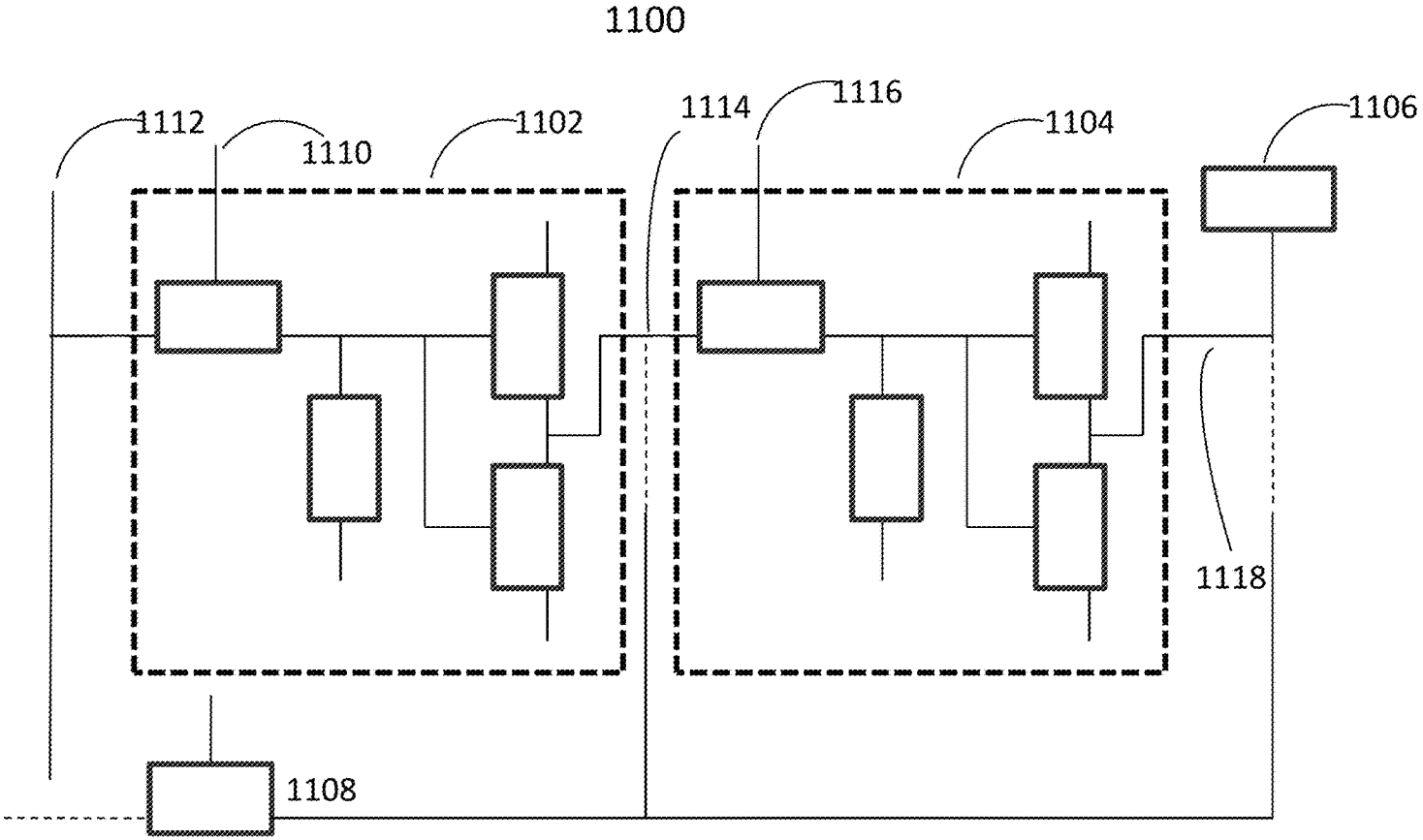
FIG. 11 shows an embodiment of an image element with planar update where there two proposed pixel cells 1102 and 1104, a mirror plate 1106 and a pass device 1108 for read back.

FIG. 11 shows an embodiment of an image element with planar update. FIG. 11 shows two proposed pixel cells 1102 and 1104, a mirror plate 1106 and a pass device 1108 for read back. When the planar update happens, all the data of the pixel cells in a pixel array are updated simultaneously, removing artifacts resulted from, for example, transitional image displays. The two pixel cells 1102 and 1104 are cascaded to form one pixel cell with the planar update capability. The cell 1102 stores the updated data while the cell 1104 stores the data in display. The control node 1110 of the cell 1102 writes the signal at the data node 1112 to the cell 1102. The write data is inverted at the node 1114. The control node 1116 of the cell 1104 writes the signal at the node 1114 to the cell 1104. The data at the node 1112 is thus updated at the node 1118. The control node 1116 can be connected together with the control node of other pixel cells. Data in these pixel cells connected to the same control node is updated simultaneously.

In LCoS, the liquid crystal layer is sandwiched between a mirror plate controlled by a pixel underneath it, and a common Indium-Tin-Oxide (ITO) layer above a liquid crystal layer. The birefringence mechanism used in steering the light polarity in LCoS responds to the magnitude of an electric field applied to the liquid crystal. The direction of the electric field does not matter. The electric field applied to the liquid crystal layer has to reach electrically neutral in the long term, avoiding impurities in liquid crystal to cause permanent damage.

Figure 12B:
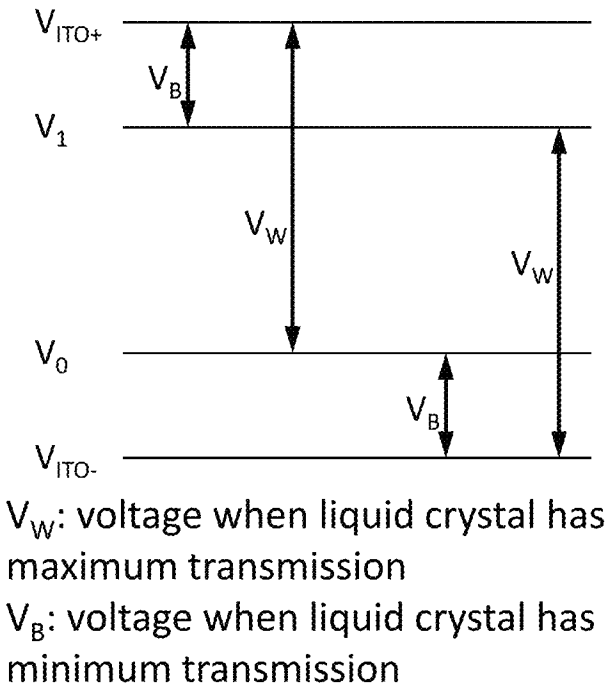
FIG. 12A and FIG. 12 B show, respectively, a voltage magnitude curve between the mirror and ITO layers and relationships among the voltages applied thereon.
Figure 12A:
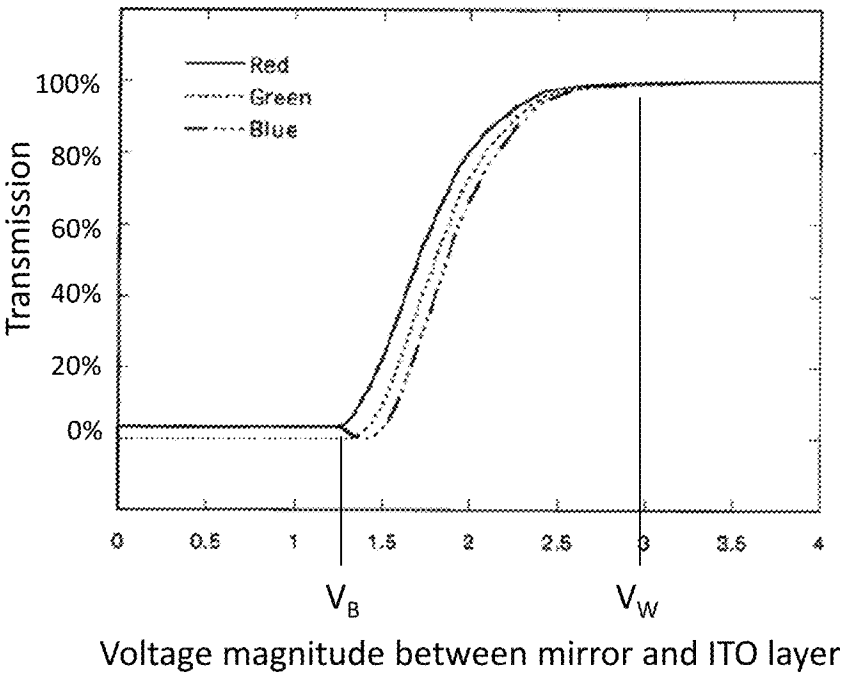

A common practice to reach the electric field neutral is to apply "field invert" (FI) periodically. "Field invert" applies the equal amount of voltage difference across the liquid crystal but with inverted polarity, i.e., a voltage difference DV from ITO layer to mirror plate is inverted to −DV. So the common practice is to change the ITO voltage from VITO+ to VITO− while changing mirror plate voltage from V1 to V0, and V0 to V1, the magnitude of DV is retained while the electric field polarity changes. FIG. 12A and FIG. 12 B show, respectively, a voltage magnitude curve between the mirror and ITO layers and relationships among the voltages applied thereon.

Figure 13B:
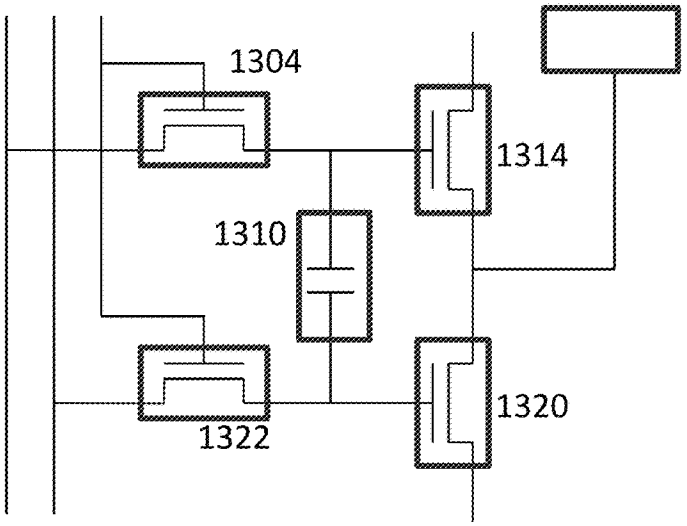
FIG. 13B shows an exemplary implementation of FIG. 13A in CMOS.
Figure 13A:
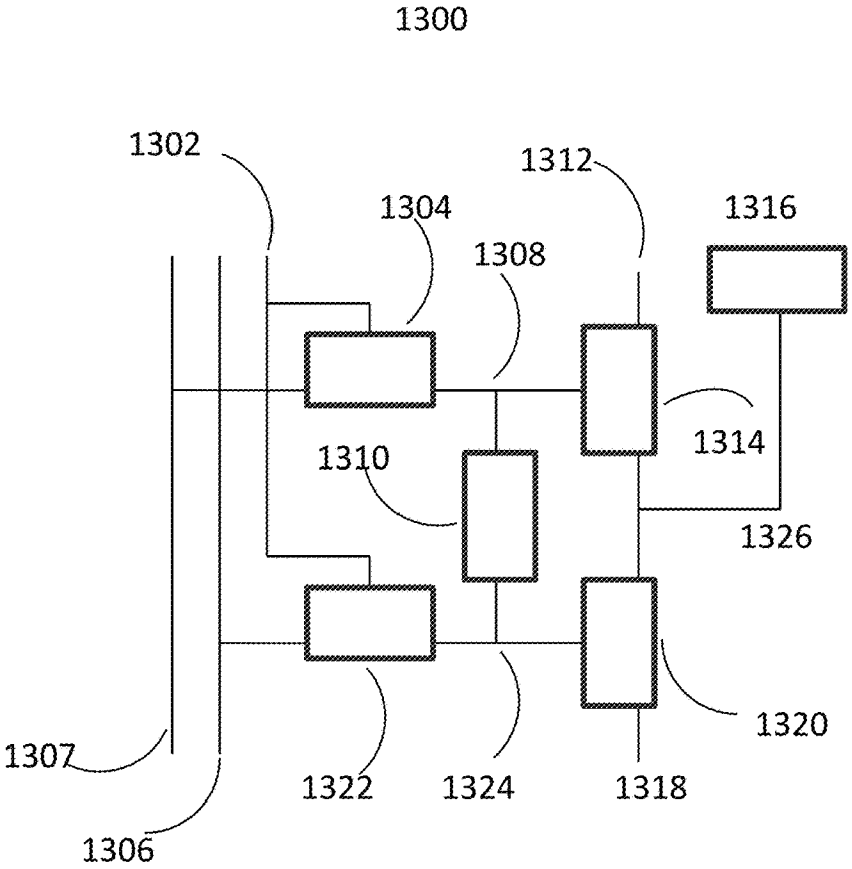
FIG. 13A shows one exemplary embodiment of a pixel cell with field invert.

FIG. 13A shows one exemplary embodiment 1300 of a pixel cell with field invert. Similar to FIG. 8A, a node 1302 controls the state of pass device 1304 and pass device 1322. When the device 1304 is at ON state, a signal at node 1306 is propagated to a node 1308. When the device 1304 is at OFF state, there is no relationship between the nodes 1306 and 1308. When the device 1322 is at ON state, the signal at the node 1306 is propagated to the node 1324. When the device 1322 is at OFF state, there is no relation between the nodes 1306 and 1324.

A storage device 1310 is provided to hold up the state at the node 1308 and 1324. The data nodes 1306 and 1307 contain complementary data. For example, if the data node 1306 is "logic 1", then the data node 1307 is "logic 0", or vice versa. As a result, the data at nodes 1308 and 1324 are complementary as well.

The node 1312 is a source node for a pull-up device 1314 while the node 1318 is a source node for a pull-down device 1320. In one embodiment, the node 1312 is connected to the highest voltage level appropriate to a mirror metal plate 1316, and the node 1318 is connected to the lowest voltage level appropriate to the mirror metal plate 1316. The pull-up and pull-down devices 1314 and 1320 form a buffer stage, both are controlled by the state of the node 1308 and the node 1324 with opposite polarity. Namely, when the device 1314 is at ON state, the device 1320 is at OFF state, an output node 1324 is sourced from the node 1312. When the device 1320 is at ON state, the device 1314 is at OFF state, the output node 1324 is sourced from the node 1318.

The state of device 1314 is controlled by the node 1308 while the state of device 1320 is controlled by the node 1324. Since the nodes 1308 and 1324 have complementary data, only one of the devices 1314 and 1320 can be at ON state. The state of a destination node 1326 is determined by the state of devices 1314 and 1320. If the device 1314 is at ON state and the device 1320 is at OFF state, the signal at the node 1312 propagates to the node 1326 via the device 1314. If the device 1320 is at ON state and the device 1314 is at OFF state, the signal at the node 1318 propagates to the node 1326 via the device 1320.

Figure 14:
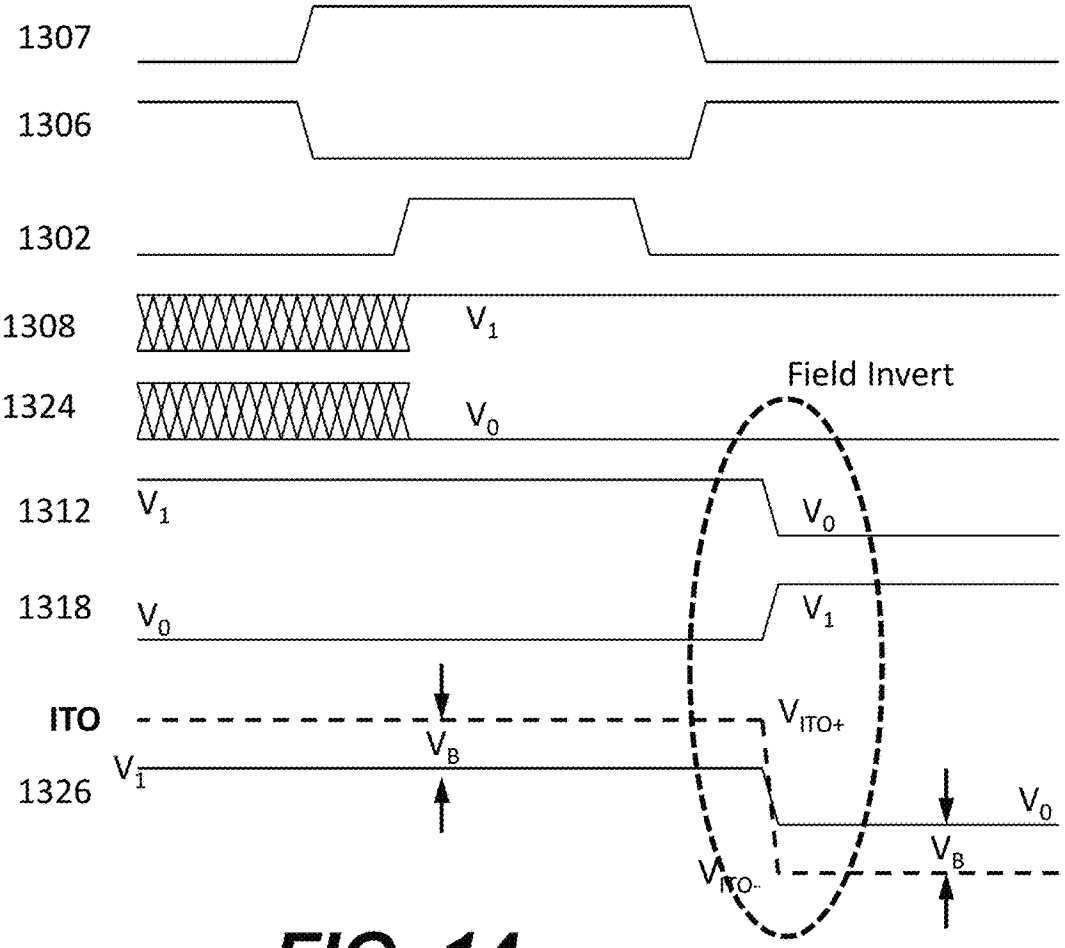
FIG. 14 shows voltages at respective nodes.

FIG. 13B shows an exemplary implementation of the block diagram 1300 of FIG. 13A in CMOS. According to one embodiment, NMOS is assigned to the pass devices 1304 and 1322. NMOS is assigned to the pull-up device 1314. NMOS is assigned to the pull-down device 1320. The storage device 1310 can be a capacitor, including MOS gate capacitor, MIM capacitor, or deep trench capacitor. V1 or V0 is assigned to the node 1312, where V1 is the highest voltage suitable to the mirror plate 1316 and V0 is the lowest voltage suitable to the mirror plate 1316. Similarly, V0 or V1 is assigned to the node 1318. The nodes 1306 and 1302 are the data node and control node for the pass device 1304, respectively, and toggle between VH and VL. In one embodiment, VH is the voltage level for logic "1" state and VL is the voltage level for logic "0" state. FIG. 14 shows the voltages at respective nodes.

Figure 15B:
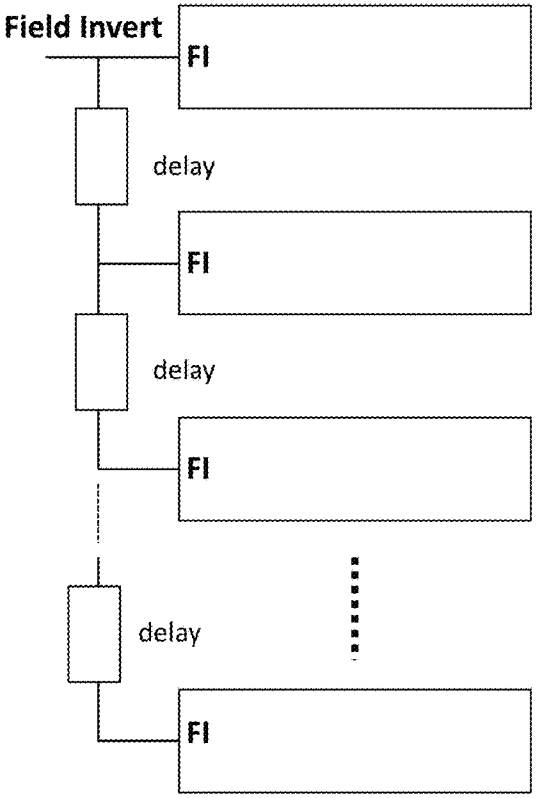
FIG. 15B shows a time delay element is inserted between two groups of field inverters.
Figure 15A:
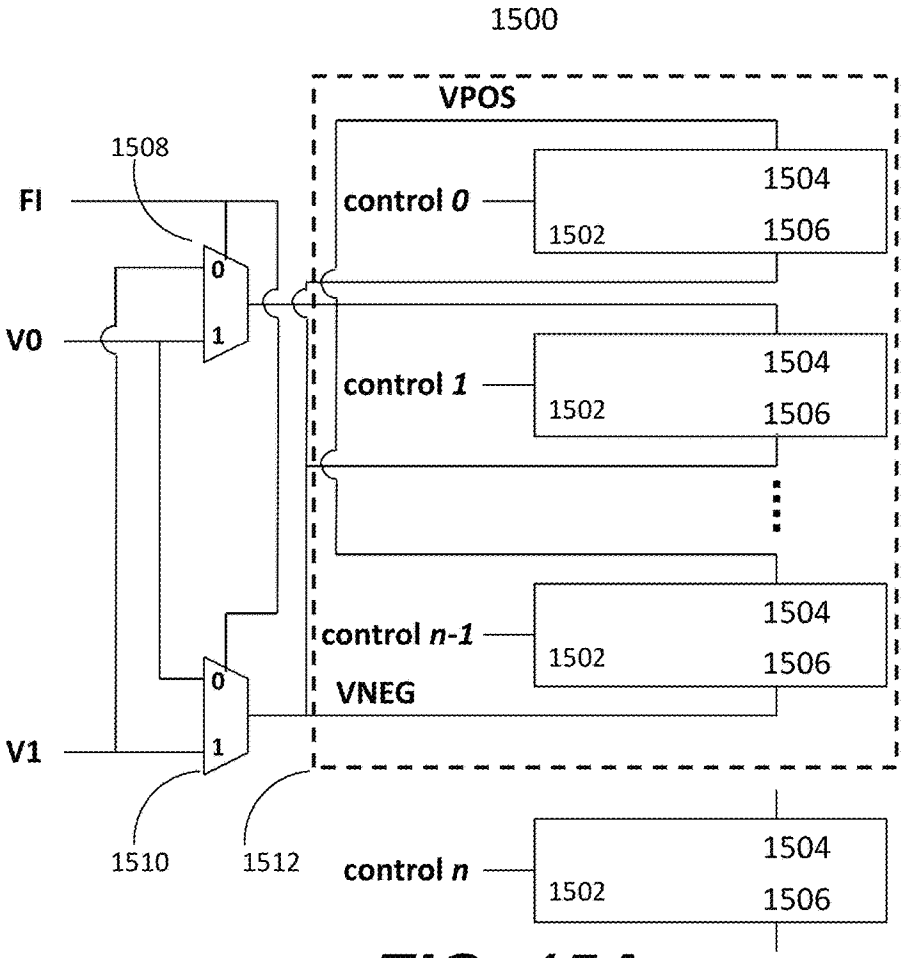
FIG. 15A shows a functional block diagram of cascading several field inverters.

Referring now to FIG. 15A, it shows a functional block diagram 1500 of cascading several field inverters. There are one row of pixel cells 1502, each having a source node 1504 and another source node 1506. The source nodes 1504 of the pixel cells 1502 are tied together or coupled together to form a VPOS node and the source nodes 1506 of the pixel cells 1502 are tied together to form a VNEG node. A switch 1508 is provided for the VPOS node while a switch 1510 is provided for the VNEG node. The switcher 1508 and 1510 are respectively driven with V1 and V0 as inputs thereto.

Reference 1512 indicates a group of n rows of the pixel cells 1502, denoted row 0 to row n-1, all of the VPOS nodes are tied or coupled together and their VNEG nodes are also tied or coupled together. Subsequent rows of the total display pixel array are also grouped as multiple groups of n rows.

The switches 1508 and 1510 are controlled by a signal FI (field invert). When FI is logic "0", VPOS is driven to V1 by the switch 1508 and VNEG is driven to V0 by 1510. When FI is logic "1", VPOS is driven to V0 by the switch 1508 and VNEG is driven to V1 by 1510. A time delay element is inserted between FI signals of the group 1512 and its adjacent groups as shown in FIG. 15B. Each group 1512 of n rows starts the field invert operation at different time step, delayed by a certain time step (predefined) than its preceding group of n rows. As a result, operating field invert by the cascading order reduces the overall power surge and switching noise.

Figure 16A:
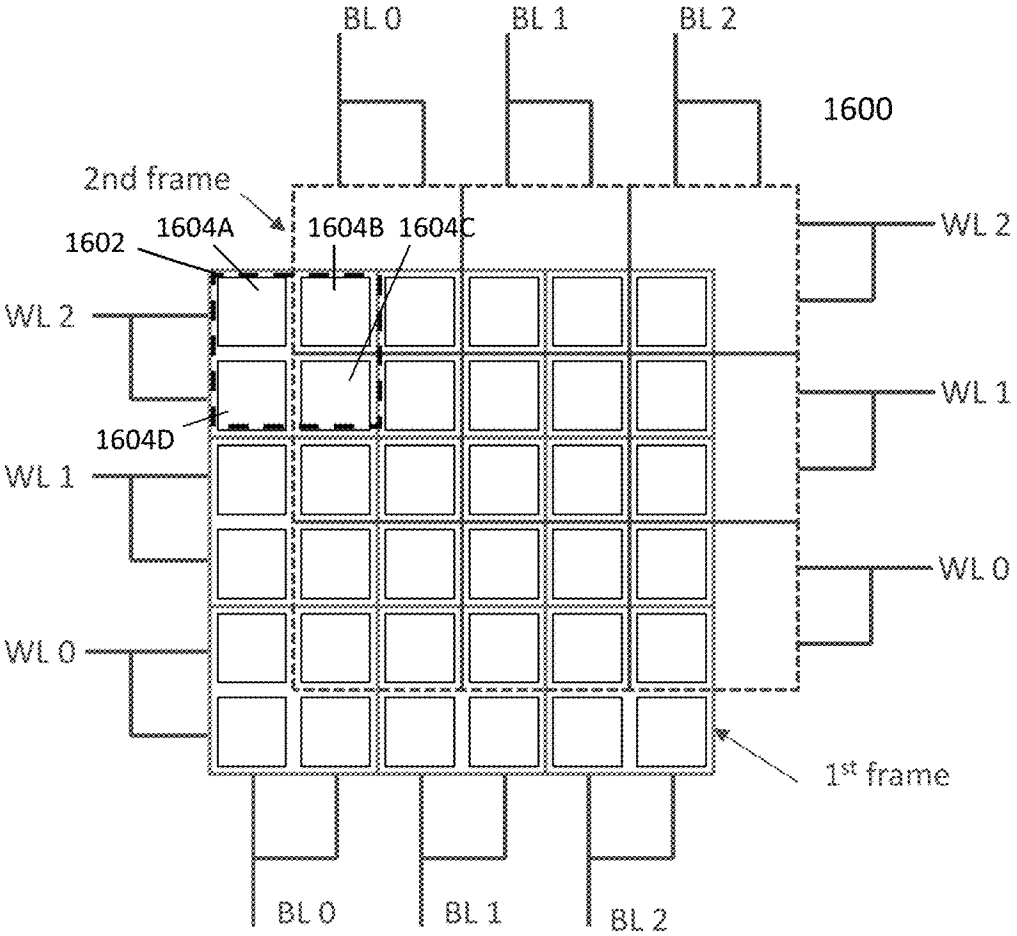
FIG. 16A shows an array of pixel elements, as an example, each of the pixel elements is shown to have four sub-image elements.

As described above, one embodiment of the present invention is to double the perceived spatial resolution of an input image based on the sub-image element architecture (e.g., shown in FIG. 4). Referring now to FIG. 16A, it shows an array of pixel elements 1600, as an example, each 1602 of the pixel elements 1600 is shown to have four sub-image elements 1604A, 1604B, 1604C and 1604D. When an input image of a first resolution (e.g., 500×500) is received and displayed in the first resolution, each of the pixel values is stored in each of the pixel elements 1600. In other words, the sub-image elements 1604A, 1604B, 1604C and 1604D are all written or stored with the same value and are addressed at the same time. As shown in FIG. 16A, the word line (e.g., WL 0, WL 1 or WL 2) addresses two rows of sub-pixels belonging to the pixel 1602 at the same time while the bit line (e.g., BL 0, BL 1 or BL 2) addresses two columns of sub-pixels belonging to the pixel 1602 at the same time. At any moment, a pixel value is written to a pixel 1602, the sub-image elements 1604A, 1604B, 1604C and 1604D therein are all selected. In the end, the input image is displayed in the first resolution (e.g., 500×500), namely the same resolution as that of the input image.

Figure 16B:
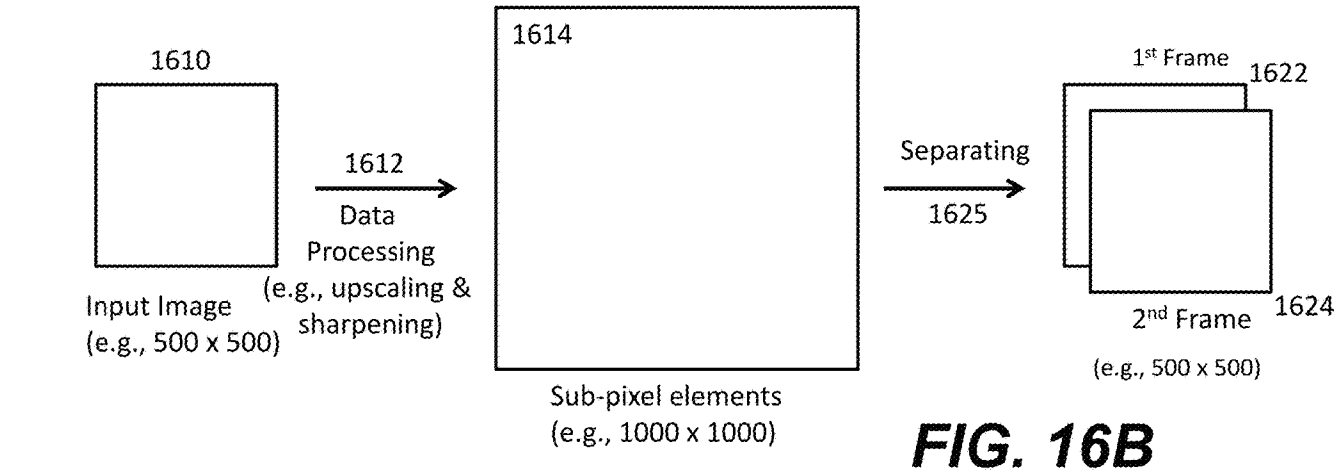
FIG. 16B shows a concept of producing an expanded image from which two frames are generated.
Figure 16C:
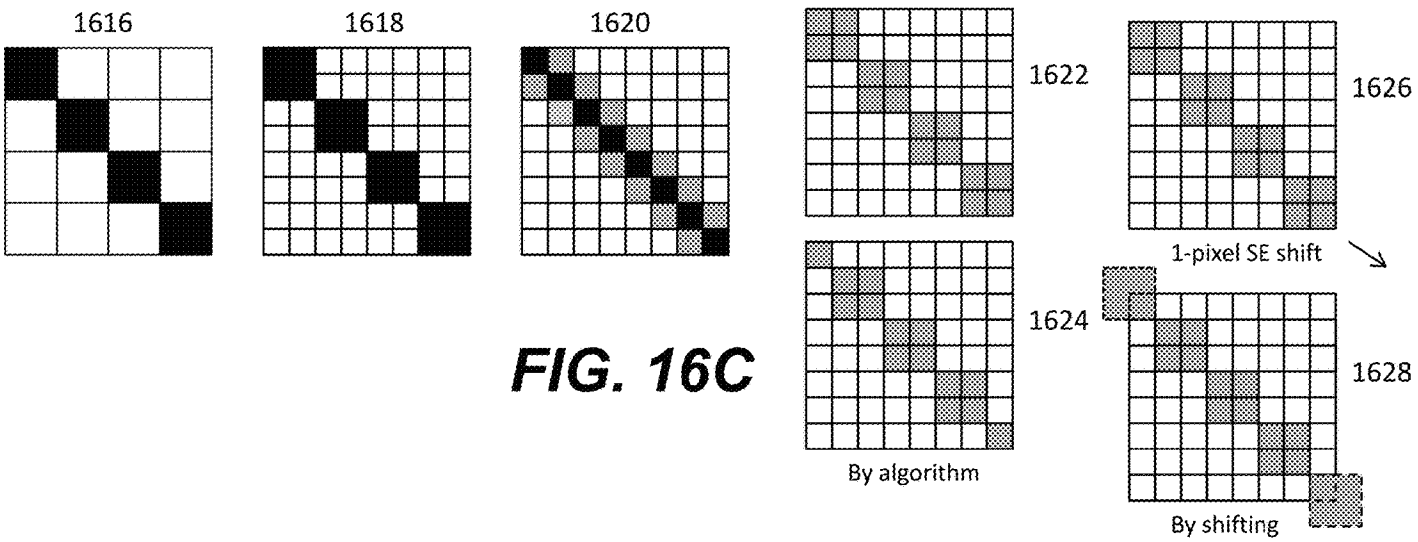
FIG. 16C shows an example of an image expanded to an image of double size in the sub-pixel elements by writing a pixel value into a group of all (four) sub-pixel elements, where the expanded is processed and separated into two frames via two approaches.

It is now assumed that an input image of a first resolution (e.g., 500×500) is received and displayed in a second resolution (e.g., 1000×1000), where the second resolution is twice as much as that the first resolution. According to one embodiment, the sub-pixel elements are used to achieve the perceived resolution. It is important to note that such improved spatial resolution is perceived by human eyes, not actually the doubled resolution of the input image. To facilitate the description of the present invention, FIG. 16B and FIG. 16C are used to show how an input image is expanded to achieve the perceived resolution.

It is assumed that an input image 1610 is of 500×500 in resolution. Through a data process 1612 (e.g., upscaling and sharpening), the input image 1610 is expanded to reach an image 1614 in dimension of 1000×1000. FIG. 16C shows an example of an image 1616 expanded to an image 1618 of double size in the sub-pixel elements. In operation, each of the pixels in the image 1616 is written into a group of all (four) sub-pixel elements (e.g., the exemplary sub-pixel structure of 2×2). Those skilled in the art that the description herein is readily applicable to other sub-pixel structures (3×3, 4×4 or 5×5, and etc), resulting in even more perceived resolution. According to one embodiment, a sharpening process (e.g., part of the data processing 1612 of FIG. 16B) is applied to the expanded image 1618 to essentially process the expanded image 1618 (e.g., filtering, thinning or sharpening the edges in the images) for the purpose of generating two frames of images from the expanded image 1618. In one embodiment, the value of each sub-pixel is algorithmically recalculated to better define the edges and produce the image 1620, In another embodiment, values of neighboring pixels are referenced to sharpen an edge.

The processed image 1620 is then separated into two images 1622 and 1624 by the separation process 1625. Both 1622 and 1624 have a resolution same as that of the input image (e.g., 500×500), where the sub-pixel elements of images 1622 and 1624 are all written or stored with the same value. The boundary of pixel elements in the image 1622 is purposely to be different from the boundary of pixel elements in the image 1624. In one embodiment, the boundary of pixel elements are offset by half-pixel (one sub-pixel in a 2×2 sub-pixel array) vertically and by half-pixel (one sub-pixel in a 2×2 sub-pixel array) horizontally. The separation process 1625 is done in a way that, when overlapping images 1622 and 1624, the combined image can best match the image 1620 of quadruple resolution of the input image 1616. For the example in FIG. 16C, to keep the constant intensity of the input image 1610, the separation process 1625 also includes a process of reducing the intensity of each of the two images 1622 and 1624 by 50%. Operationally, the intensities in the first image is reduced by N percent, where N is an integer and ranged from 1 to 100, but practically is defined around 50. As a result, the intensities in the second image is reduced by (100−N) percent. These two images 1622 and 1624 are displayed alternatively at twice the refresh rate as that for the original input image 1610. In other words, if the input image is displayed at 50 Hz per second, each of pixels in two images 1622 and 1624 are displayed 100 Hz per second. Due to the offset in pixel boundary and data process, viewers perceive the combined image close to the image 1620. Offsetting the pixel boundary between images 1622 and 1624 has the effect of "shifting" pixel boundary. As illustrated as two images 1626 and 1628 according to another embodiment, the example in FIG. 16C is like shifting a (sub)pixel in southeast direction.

Figure 16D:
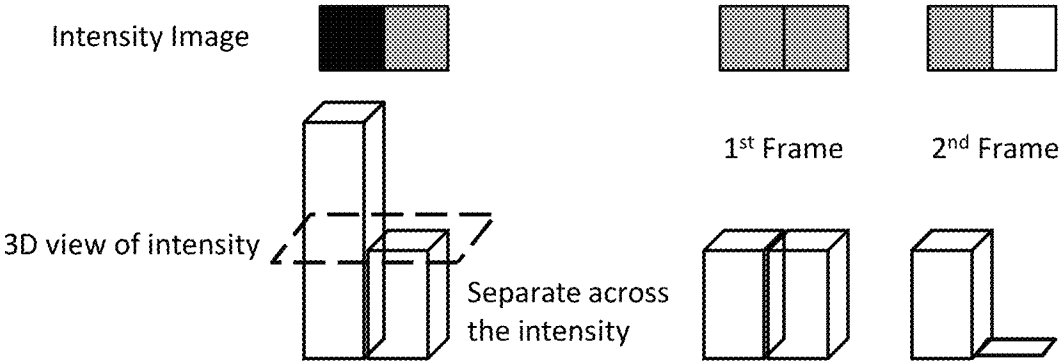
FIG. 16 D illustrates what it is means by separating an image across its intensities to produce two frames of equal size to the original image.
FIG. 16E shows another embodiment to expand an input image to an expanded image with two decimated and interlaced images.
FIG. 16F shows a flowchart or process of generating two frames of image for display in an improved perceived resolution of an input image.

Depending on implementation, the separation process 1625 may be performed based on an image algorithm or one-pixel shifting, wherein one-pixel shifting really means one sub-pixel in the sub-pixel structure as shown in FIG. 16A. There are many ways to separate an image of N×M across the intensity into two images, each of N×M, so that the perceived effect of displaying the two images alternatively at the twice refresh rate reaches the visual optimum. For example, one exemplary approach is to retain/modify the original image as a first frame with reduced intensity while producing the second frame with the remaining from the first frame, again with reduced intensity. Another exemplary approach is to shift one pixel (e.g., horizontally, vertically or diagonally) from the first frame (obtained from the original or an improved thereof) to produce the second frame, more details will be provided in the sequel. FIG. 16C shows that two images 1622 and 1624 are produced from the processed expanded image 1620 per an image algorithm while that two images 1626 and 1628 are generated by shifting the first frame on pixel diagonally to produce the second frame. It should be noted that the separation process herein means to separate an image across its intensities to produce two frames of equal size to the original image. FIG. 16D illustrates an image of two pixels, one being full intensity (shown as black) and the other one being one half of the full intensity (shown as grey). When the two pixel image is separated into two frames of equal size to the original, the first frame has two pixels, both being one half of the full intensity (shown as grey) and the second frame also has two pixels, one being one half of the full intensity (shown as grey) and the other being almost zero percent of the full intensity (shown as white). Now there are twice as many pixels as the original input image, displayed in a checkerboard pattern. Since each pixel is refreshed only 60 times per second, not 120, the pixels are half as bright, but because there are twice as many of them, the overall brightness of the image stays the same.

Figure 16E:
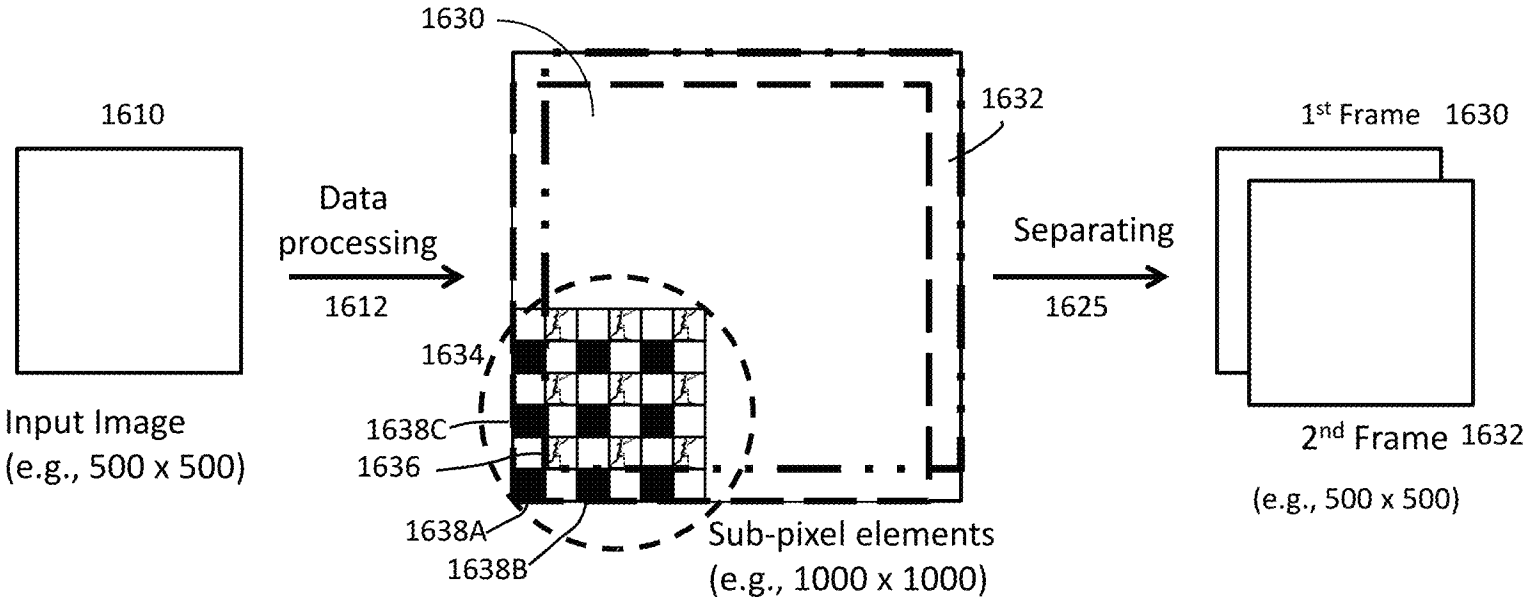

Referring now to FIG. 16E, it shows another embodiment to expand an input image 1610. It is still assumed that the input image 1610 is of 500×500 in resolution. Through the data process 1612, the input image 1610 is expanded to reach a dimension of 1000×1000. It should be noted that 1000×1000 is not the resolution of the expanded image in this embodiment. The expanded image has two 500×500 decimated images 1630 and 1632. The expanded view 1634 of the decimated images 1630 and 1632 shows that pixels in one image is decimated to allow the pixels of another image to be generated therebetween. According to one embodiment of the present invention, the first image is from the input image while the second image is derived from the first image. As shown in the expanded view 1634 of FIG. 16E, an exemplary pixel 1636 of the second image 1632 is derived from three pixels 1638A, 1638B and 1638C. The exemplary pixel 1632 is generated to fill the gap among three pixels 1638A, 1638B and 1638C. The same approach, namely shifting by one pixel, can be applied to generate all the pixels for the second image along a designated direction. At the end of the data processing 1612, there is an interlaced image including two images 1630 and 1632, each is of 500×500. A separation process 1625 is applied to the interlaced image to produce or restore therefrom two images 1630 and 1632.

Figure 16F:
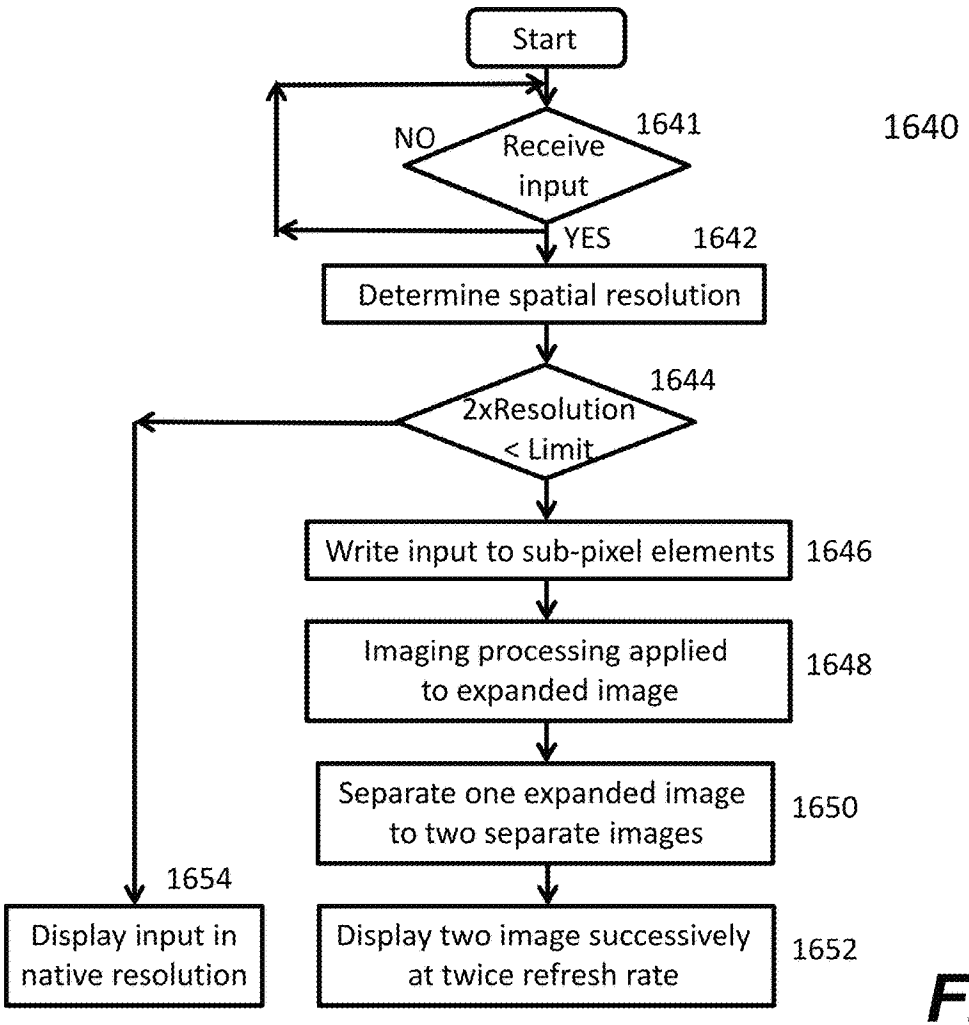

Referring now to FIG. 16F, it shows a flowchart or process 1640 of generating two frames of image for display in an improved perceived resolution of an input image. The process 1640 may be implemented in software, hardware or in combination of both, and can be better understood in conjunction with the previous drawings. The process 1640 starts when an input image is received at 1641.

The resolution of the input image is determined at 1642. The resolution may be given, set or detected win the input image. In one case, the resolution of the input image is passed along. In another case, the resolution is given in a head file of the input image, where the head file is read first to obtain the resolution. In still another case, the resolution is set for a display device. In any case, the resolution is compared to a limit of a display device at 1644, where the limit is defined to be the maximum resolution the display device can display according to one embodiment of the present invention.

It is assumed that the limit is greater than 2 times the resolution obtained at 1642. That means a display device with the limit can "double" the resolution of the input image. In other words, the input image can be displayed in much improved perceived resolution than the original or obtained resolution. The process 1640 moves to 1646 where the pixels values are written into pixel elements, where each of the pixel elements has a group of sub-pixels. In operation, it is essentially an upscale process. At 1648, applicable image processing is applied to the expanded image. Depending on implementation, exemplary image processing may include sharpening, edge detection, filtering and etc. The purpose of the image processing at this stage is to minimize errors that may have been introduced in the upscale operation when separating the expanded image into two frames. It should also be noted that the upscale process or the image processing may involve the generation of a second frame based on a first frame (the original or processed thereof) as illustrated in FIG. 16C. At the end of 1648, an expanded image that has been processed applicably is obtained.

At 1650, the expanded image is going under image separation to form two independent two frames. As described above, there are ways to separate an image across the intensity into two frames of equal size to the image. In other words if the image is of M×N, each of the two frames is also of M×N, where only the intensity of the image is separated. Regardless of whatever an algorithm is used, the objective is to keep the same perceived intensity and minimize any artifacts in the perceived image when the two frames are alternatively displayed at the twice refresh rate (e.g., from 50 frames/sec to 100 frames/sec) at 1652.

Back to 1644, now it is assumed the limit is less than 2 times the resolution obtained at 1642. That means a display device with the limit cannot "double" the resolution of the input image. In other words, it is practically meaningless to display an image in a resolution exceeding that of the display device unless some portions of the image are meant to be chopped off from display. The process 1640 now goes to 1654 to display the image in native resolution. One of the objectives, benefits and advantages in the present invention is the inherent mechanism to display images in their native resolutions while significantly improving the perceived resolution of an image when the native resolution is not of high.

It should be noted that the process 1640 of FIG. 16F is based on embodiment. Those skilled in the art can appreciate that not every block must be implemented as described to achieve what is being disclosed herein. It can also be appreciated that the process 1640 can practically reduce the requirement for the memory capacity. According to one embodiment, instead of providing memory for storing two frames of image, only the memory for the first frame may be sufficient. The second frame may be calculated or determined in real time.

Figure 17A:
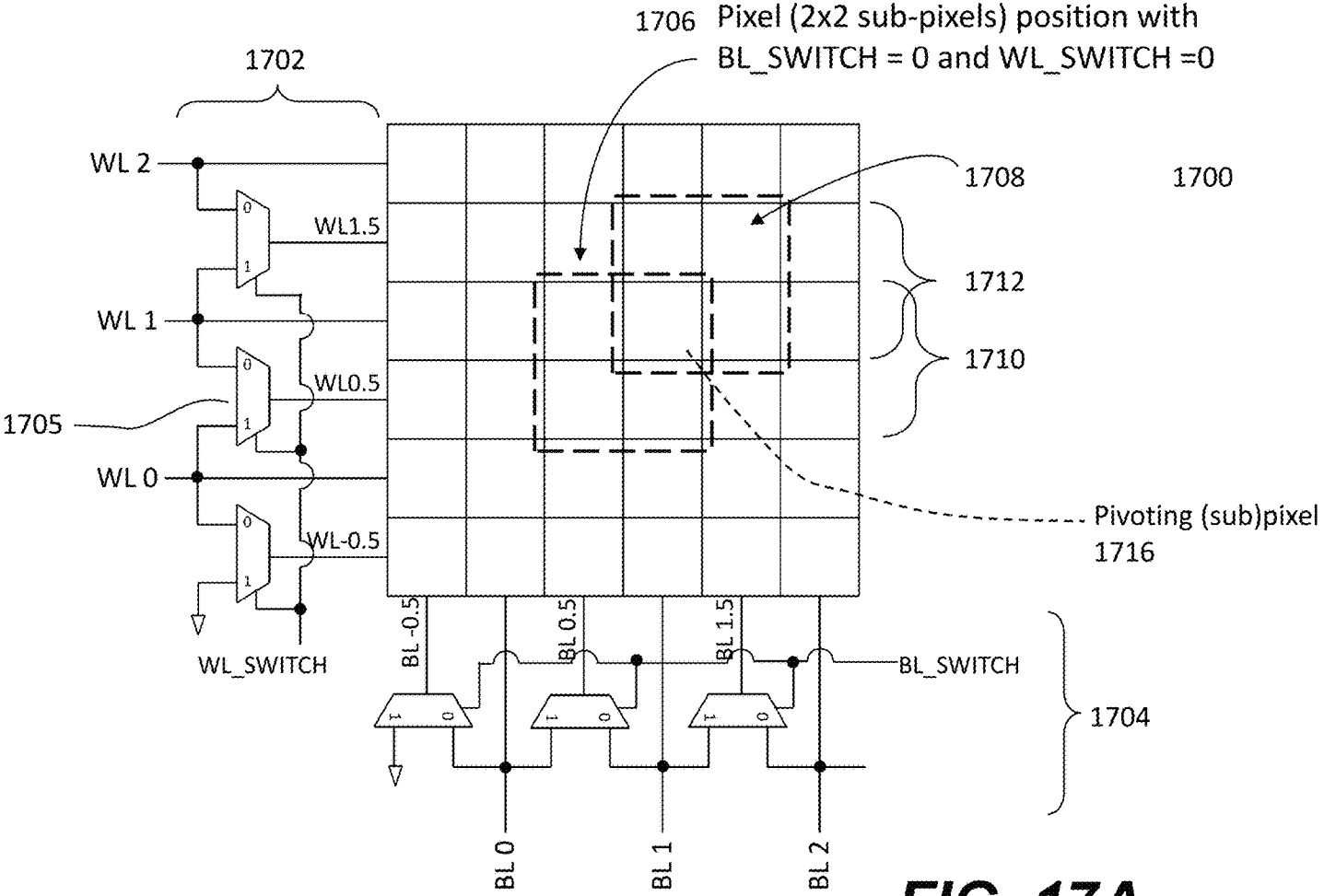
FIG. 17A shows an exemplary control circuit to address the sub-pixel elements.

Referring now to FIG. 17A, it shows an exemplary control circuit to address the sub-pixel elements 1700. Similar to FIG. 1, the X-address bits 1702 decode the location of control line (word line) of an image element while the Y-address bits decode the location of data line (bit line) of the image element. The set of circuits that decode the X-address bits into selected control lines (word lines) is called X-decoder 1702. The set of circuits that decode Y-address bits into selected data lines (bit lines) is called Y-decoder 1704. However, one of the differences between FIG. 1 and FIG. 17A is that the X-decoder 1702 and Y-decoder 1704 can address two lines at a time. For example, as shown in FIG. 17A, when both BL_SWITCH and WL_SWITCH are set to 0, a group of four sub-pixels 1706 are selected by word line WL1 and data line BL 1. In another operation, when both BL_SWITCH and WL_SWITCH are set to 1, a group of four sub-pixels 1708 are selected.

Figure 17B:
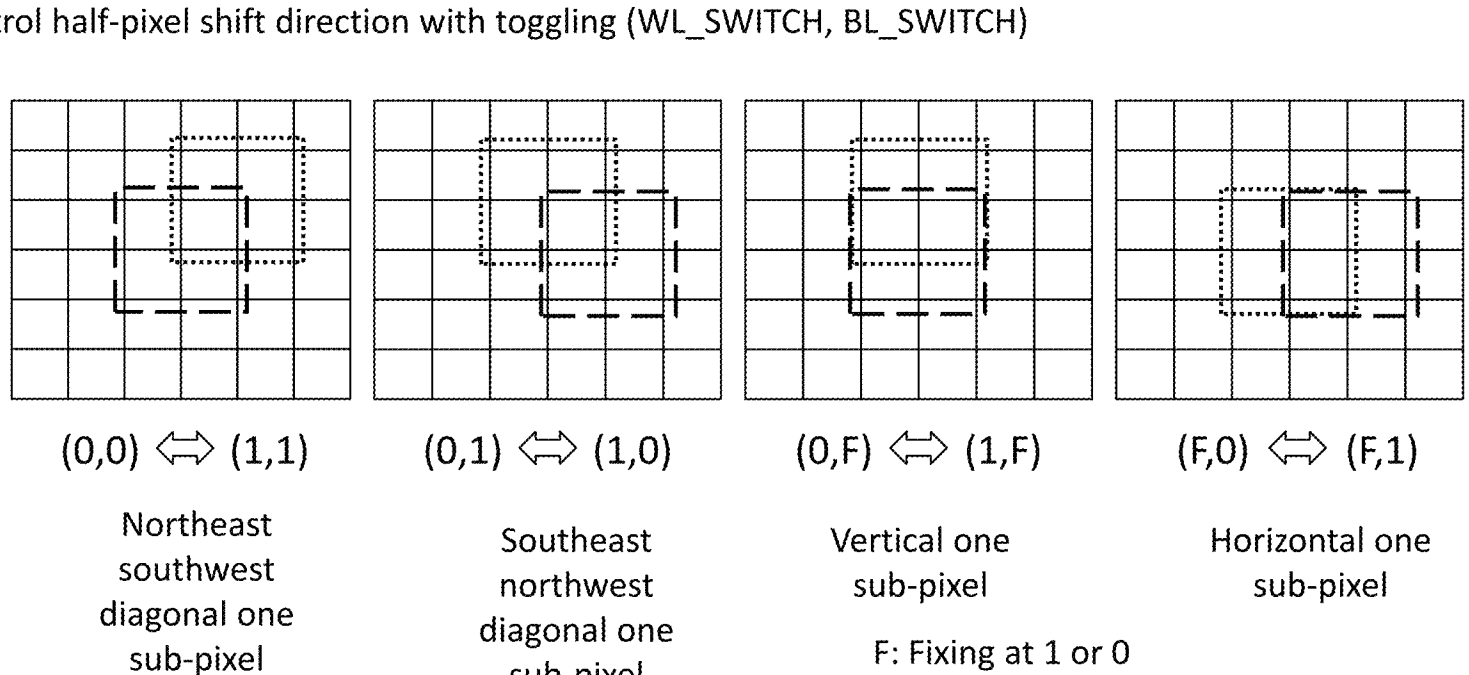
FIG. 17B shows some exemplary directions a pixel (including a group of sub-pixels) may be shifted by a sub-pixel.

As an example shown in FIG. 17A, each of the X-decoder 1702 and Y-decoder 1704 address two lines simultaneously by using a multiplexor or switch 1705 to couple two switch signals WL1 and WL0, each of which is selected by a control signal WL_SWITCH. Controlled by the control signal WL_SWITCH being either 1 or 0, two neighboring lines 1710 or 1712 are simultaneously addressed by the X-decoder 1702. The same is true for the Y-decoder 1704. As a result, the sub-pixel elements 1706 and the sub-pixel elements 1706 are respectively selected when WL_SWITCH is switched from 0 to 1 and at the same time BL_SWITCH is switched from 0 to 1. In a perspective, the sub-pixel group 1706 is moved diagonally (along the north-east or NE) by one sub-pixel to the sub-pixel group 1708. FIG. 17B shows some exemplary directions a pixel (including a group of sub-pixels) may be shifted by a sub-pixel in association with toggling control signals WL_SWITCH and BL_SWITCH.

Referring back to FIG. 17A, as each time, the sub-pixel group 1706 or the sub-pixel group 1708 is shifted by one-half sub-pixel group or one sub-pixel, it can be observed that one sub-pixel is fixed or always addressed when WL_SWITCH is switched from 0 to 1 or 1 to 0 and BL_SWITCH is switched from 0 to 1 or 1 to 0. This fixed sub-pixel is referred to herein as a pivoting (sub)pixel, essentially one of the sub-pixels in a sub-pixel group or pixel element. As will be further described below, circuitry facilitating to implement one of the embodiment in the present invention can be significantly simplified, resulting in less components, smaller die size and lower cost.

Figure 18A:
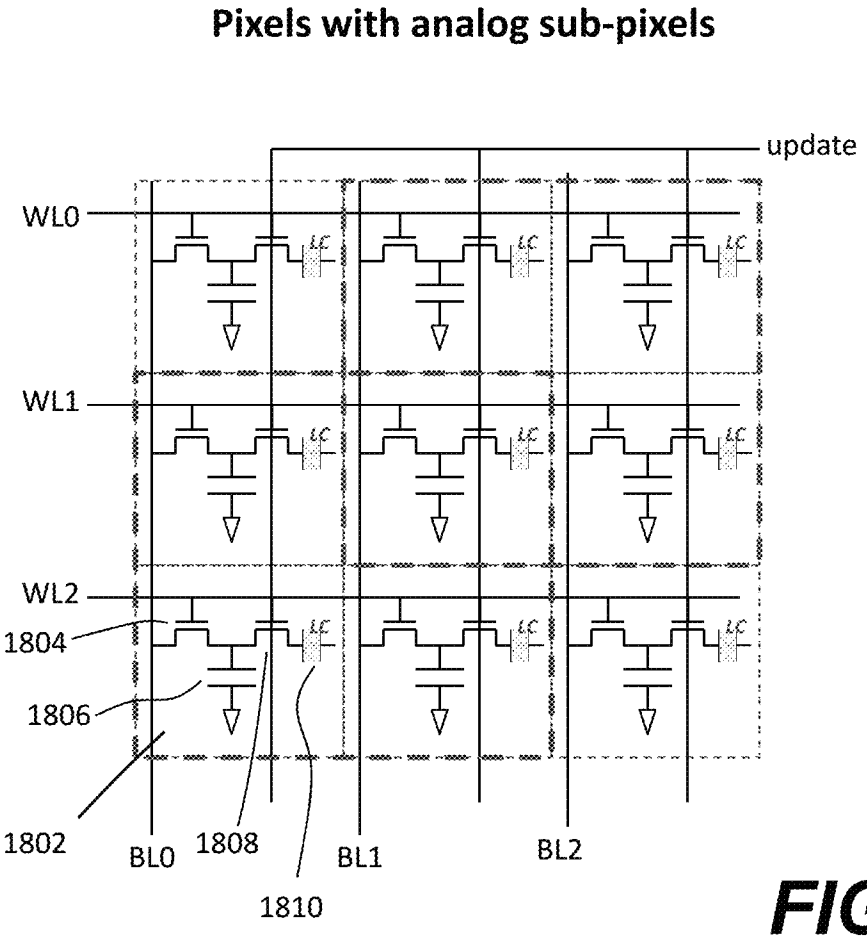
FIG. 18A shows a circuit implementing the pixels or pixel elements with analog sub-pixels, each of the sub-pixels is based on an analog cell.
Figure 18C:
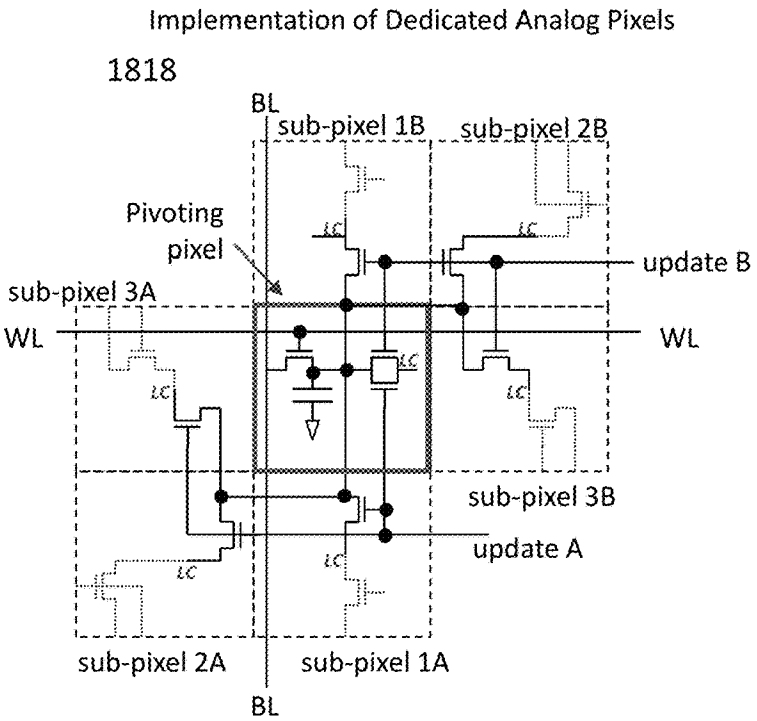
FIG. 18C shows an exemplary circuit simplified from, the circuit of FIG. 18A based on the concept of pivoting pixel.
Figure 18B:
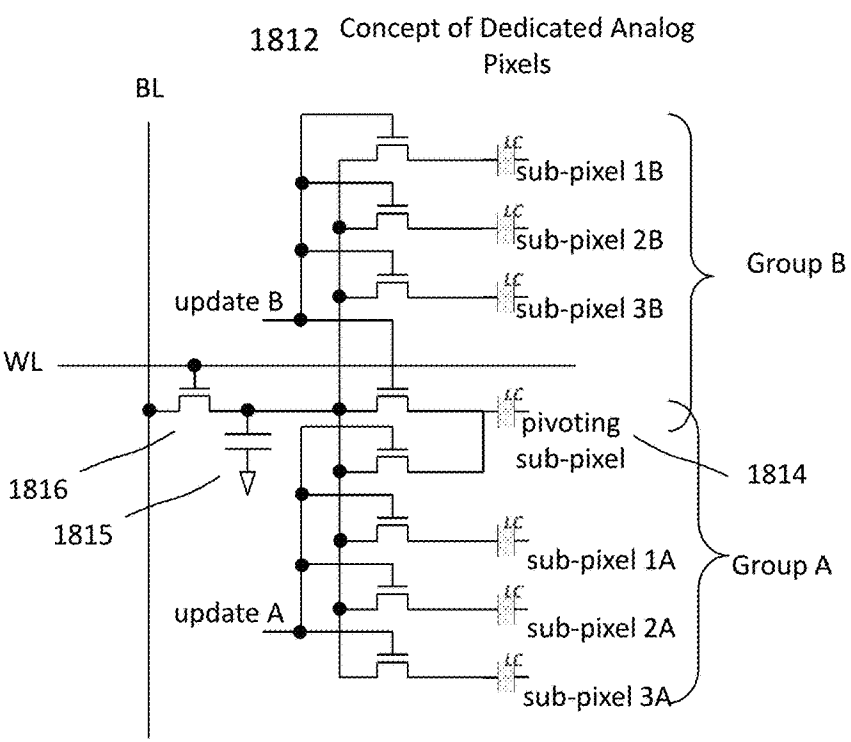
FIG. 18B shows a concept of sharing the pivoting sub-pixel in two pixel elements.

Referring now to FIG. 18A, it shows a circuit 1800 implementing the pixels or pixel elements with analog sub-pixels. Each of the sub-pixels is based on an analog cell. Similar to FIG. 7A, an analog cell 1802 includes a pass device 1804 and one capacitor 1806 to store a charge for the sub-pixel. A pass device 1808 is provided to transfer the charge on the capacitor 1806 to the mirror plate of liquid crystal (LC) 1810, which may also serve as a capacitor. Instead of using identical analog cells as sub-pixels, the circuitry by utilizing the shared pivoting pixel of two shift positions can be further simplified. FIG. 18B shows two pixel elements A and B each including four sub-pixels, where one sub-pixel is the pivoting pixel 1814 shared in each of the two pixel elements A and B. It can be observed that the pivoting pixel needs to be updated by either one of the two pixel elements A and B, and is always selected. As a result, the circuit 1800 of FIG. 18A can be simplified to a circuit 1818 of FIG. 18C according to one embodiment of the present invention. The circuit 1818 of FIG. 18C shows that three non-pivoting cells 1A, 2A and 3A in the pixel element A are updated in accordance with the update signal A while three non-pivoting cells 1B, 2B, and 3B in the pixel element B as well as the pivoting cell are updated in accordance with the update signal B.

As further shown in FIG. 18, there is only one capacitor 1815 to serve as the storage element and one pass gate 1816 to connect the data line to capacitor 1815 within the two pixel elements A and B. Therefore, only one word line and only one data line is needed to address the storage element 1815. Shifting is performed through switching between the control signals update A and update B. When update A is 1, the video signal stored in capacitor 1815 is passed to all sub-pixels in pixel group A, including sub-pixel 1A, 2A, 3A, and the pivoting (sub)pixel 1814. When update B is 1, the video signal stored in capacitor 1815 is passed to all sub-pixels in pixel group B, including sub-pixel 1B, 2B, 3B, and the pivoting (sub)pixel 1814.

It can be observed that the pivoting pixel 1814 needs to be updated by either one of the two pixel elements A and B, and is always selected. As a result, the circuit 1800 of FIG. 18A can be simplified as only one capacitor 1815, one pass gate 1816, one word line, and one data line are needed to implement the sub-pixel shifting. Compared to the circuit 1800 of FIG. 18A, the circuit of FIG. 18B can result in smaller area for circuitry as less components, word lines and data lines are needed. The circuit 1818 of FIG. 18C shows the physical implementation of the circuit described in FIG. 18B according to one embodiment of the present invention. The circuit 1818 of FIG. 18C shows that three non-pivoting cells 1A, 2A and 3A in the pixel element A are updated in accordance with the update signal A while three non-pivoting cells 1B, 2B, and 3B in the pixel element B as well as the pivoting cell are updated in accordance with the update signal B. The pass gate and the capacitor are associated to the pivoting sub-pixel for ease of illustration. In reality, they can be placed anywhere inside the pixel group A and pixel group B boundary. For all non-pivoting sub-pixel cells, 1A, 2A, 3A, 1B, 2B, and 3B, they are shared with neighboring pixel A and pixel B cells. Neighboring pass gates coupled with update A and update B are shown in dotted lines in FIG. 18C.

Figure 19A:
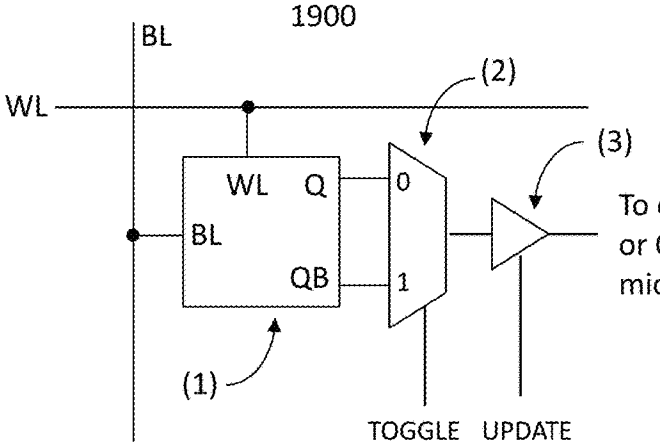
FIG. 19A shows a circuit implementing the pixels or pixel elements with digital sub-pixels, each of the sub-pixels is based on a digital memory cell (e.g., SRAM)
Figure 19B:
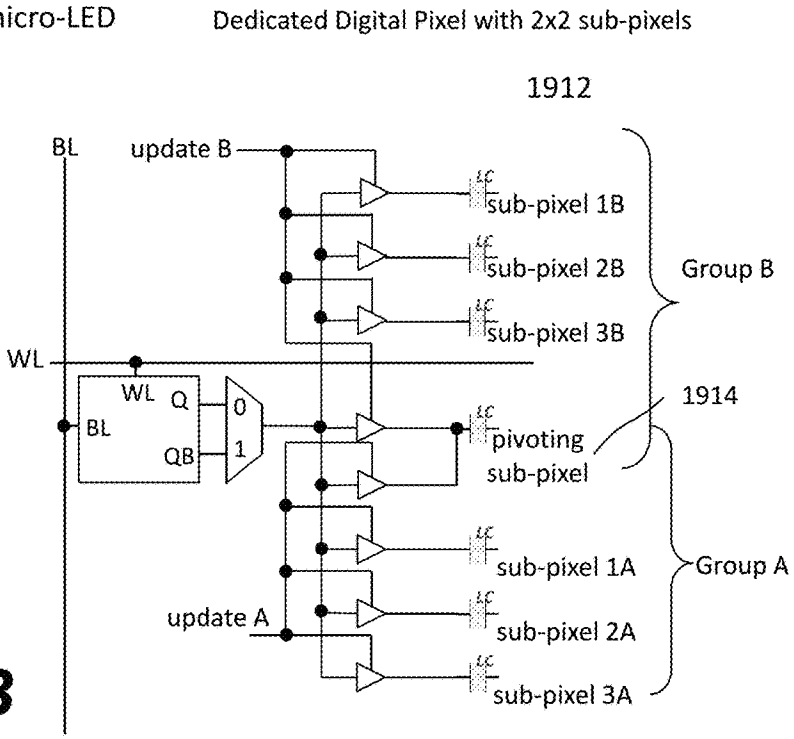
FIG. 19B shows a concept of sharing the pivoting sub-pixel in two pixel elements.
Figure 19C:
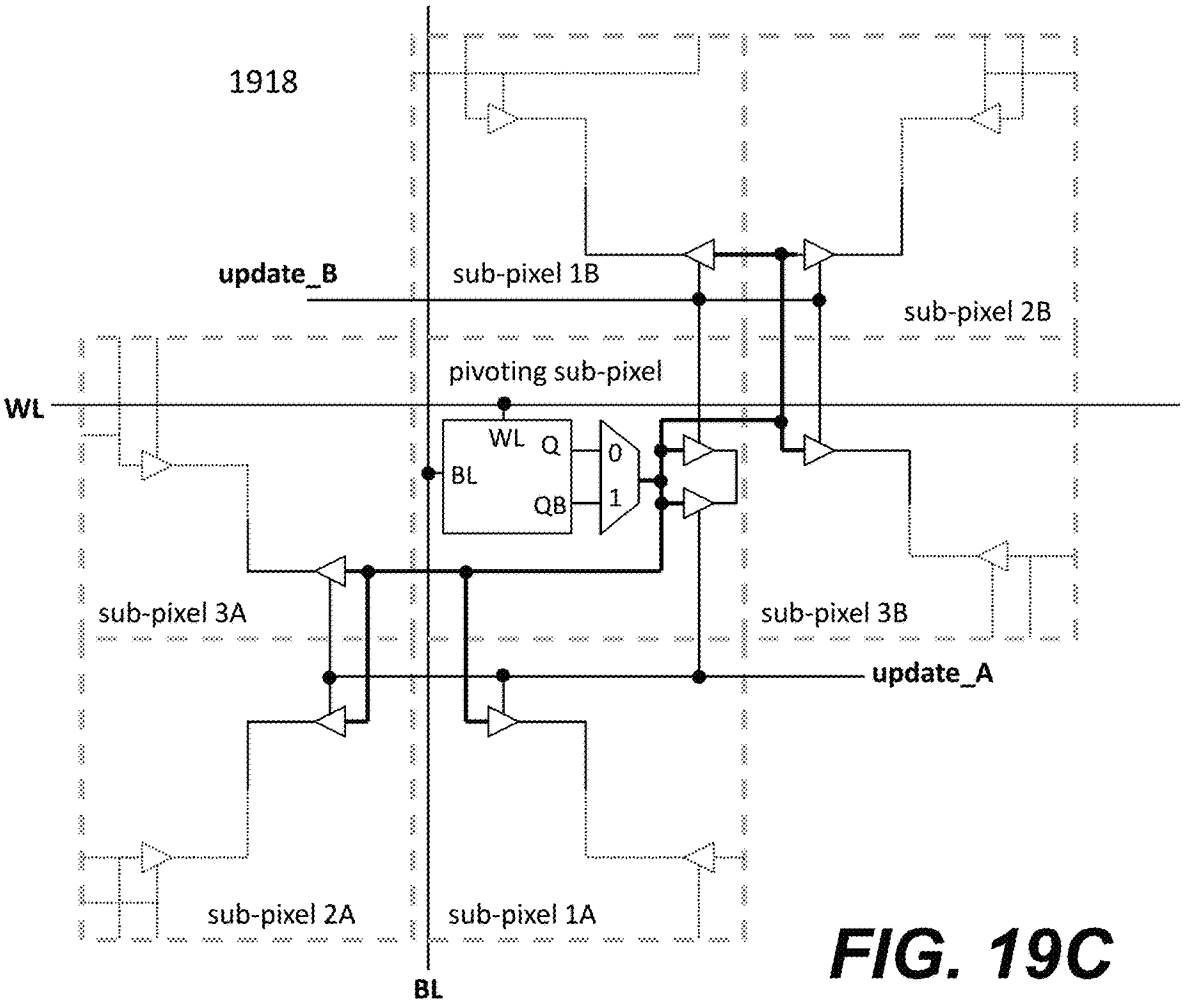
FIG. 19C shows an exemplary circuit simplified from, the circuit of FIG. 19A based on the concept of pivoting pixel.

FIG. 19A shows a digital version of a sub-pixel 1900. In one embodiment, pulse width modulation (PWM) is used to control the gray level of an image element. Similar to FIG. 7B, a static memory cell 1902 (e.g., SRAM cell) is provided to store a logic value "1" or "0" periodically. The logic value "1" or "0" signal determines that the associated element 1900 transmits the light fully or absorbs the light completely, resulting in white or black. A various mixture of the logic "1" duration and the logic "0" duration decides a perceived gray level of the element 1900. FIG. 19B shows the concept of using the pivoting sub-pixel. The circuit 1912 in FIG. 19B shows two pixel elements A and B each including four sub-pixels, where one sub-pixel is the pivoting pixel 1914 shared in each of the two pixel elements A and B. It can be observed that the pivoting (sub)pixel 1914 needs to be updated by either one of the two pixel elements A and B, and is always selected. As a result, the circuit 1900 of FIG. 19A can be simplified to a circuit 1912 of FIG. 19B according to one embodiment of the present invention. The circuit 1918 of FIG. 19C is a alternative representation of the circuitry shown in FIG. 19B. The circuit 1918 of FIG. 19C shows that three non-pivoting cells 1A, 2A and 3A in the pixel element A are updated in accordance with the update signal A while three non-pivoting cells 1B, 2B, and 3B in the pixel element B as well as the pivoting cell are updated in accordance with the update signal B.

The present invention has been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

We claim:

1. A method for displaying an input image in improved perceived resolution, the method comprising:
   determining a native resolution of the input image at an interface to a memory array;
   when the improved perceived resolution is greater than twice the native resolution: expanding the input image into an expanded image in the memory array having a plurality of pixel elements, each of the pixel elements including at least 2×2 sub-pixels;
   generating from the expanded image a first frame and a second frame of image, both of the first and second frames being of equal to the input image in size; and
   displaying the first and second frames alternatively at twice refresh rate originally set for the input image; and
   when the improved perceived resolution is less than twice the native resolution: displaying the input image in the native resolution.

2. The method as recited in claim 1, wherein said generating from the expanded image a first frame and a second frame of image comprises:
   writing each pixel value in the input image into the 2×2 sub-pixels simultaneously addressed by a pair of X-decoders and Y-decoders; and
   processing the expanded image to minimize visual errors when the first and second frames are alternatively displayed at the twice refresh rate.

3. The method as recited in claim 2, further comprising:
   deriving the first frame from the expanded image; and
   reducing intensities of the first frame by N percentage, where N is an integer in a range of 1 to 100.

4. The method as recited in claim 3, wherein said generating from the expanded image a first frame and a second frame of image comprises:
   producing the second frame from the first frame by separating the expanded image from intensities thereof; and
   reducing intensities of the second frame by (100-N) percentage.

5. The method as recited in claim 2, wherein said generating from the expanded image a first frame and a second frame of image comprises:
   shifting the first frame by one sub-pixel along a predefined direction to generate the second frame.

6. The method as recited in claim 5, wherein the predefined direction is diagonal, vertical or horizontal.

7. The method as recited in claim 6, wherein said shifting the first frame by one sub-pixel along a predefined direction to generate the second frame is achieved via controlling the X-decoders and the Y-decoders, wherein the X-decoders or Y-decoders always address two lines and two columns of the pixel elements all the time.

8. The method as recited in claim 2, wherein each of the X-decoder and Y-decoder is designed to address two lines of sub-pixels at the same time, the each of the X-decoder and Y-decoder is controlled by a switch signal to alternate a selection of two neighboring lines of sub-pixels.

9. The method as recited in claim 1, wherein said generating from the expanded image a first frame and a second frame of image comprises:
   deriving the first frame from the input image;
   decimating the first frame by one sub-pixel; and
   interpolating the second frame from the first frame by creating a value among two or three neighboring sub-pixels in the decimated first frame so that the second frame includes all interpolated values, where said interpolating is performed diagonally vertically or horizontally with respect to the decimated first frame.

10. The method as recited in claim 9, wherein said generating from the expanded image a first frame and a second frame of image comprises:
   reducing intensities of the first and second frames by half so that the first and second frames alternatively displayed at twice refresh rate of the input image remains visually equal to the input image in intensity.

11. A device for displaying an input image in improved perceived resolution, the device comprising:
   a memory array having a plurality of pixel elements, each of the pixel elements including 2×2 sub-pixels;
   an interface to a memory array to determine a native resolution of the input image, wherein,
   when the improved perceived resolution is greater than twice the native resolution:
   the input image is expanded into an expanded image in the memory array by writing each of pixel value into the 2×2 sub-pixels;
   a first frame and a second frame of image are then generated from the expanded image, both of the first and second frames being of equal to the input image in size; and
   the first and second frames are alternatively displayed at twice refresh rate originally set for the input image; and
   when the improved perceived resolution is less than twice the native resolution: the input image is simply displayed in the native resolution.

12. The device as recited in claim 11, further including: a pair of X-decoder and Y-decoder, wherein each of the X-decoder and Y-decoder is designed to address two lines of sub-pixels at the same time, the each of the X-decoder and Y-decoder is controlled by a switch signal to alternate a selection of two neighboring lines of sub-pixels.

13. The device as recited in claim 12, further including: a controller programmed to control the switch signal to cause writing each pixel value in the input image into the 2×2 sub-pixels simultaneously; and processing the expanded image to minimize visual errors when the first and second frames are alternatively displayed at the twice refresh rate.

14. The device as recited in claim 13, wherein the first frame is derived from the expanded image, and intensities of the first frame are reduced by N percentage, where N is an integer in a range of 1 to 100.

15. The device as recited in claim 14, wherein the second frame is produced from the first frame by separating the expanded image from intensities thereof; and intensities of the second frame are reduced by (100-N) percentage.

16. The device as recited in claim 12, wherein the second frame is produced by shifting the first frame by one sub-pixel along a predefined direction to generate the second frame by controlling the switch signal to the X-decoder and Y-decoder.

17. The device as recited in claim 16, wherein the predefined direction is diagonal, vertical or horizontal.

18. The device as recited in claim 11, wherein the expanded image is produced by:
   deriving the first frame from the input image;
   decimating the first frame by one sub-pixel; and
   interpolating the second frame from the first frame by creating a value among two or three neighboring sub-pixels in the decimated first frame so that the second frame includes all interpolated values, where said interpolating is performed diagonally vertically or horizontally with respect to the decimated first frame.

* * * * *